US011974662B1

(12) United States Patent
Crudo et al.

(10) Patent No.: US 11,974,662 B1
(45) Date of Patent: May 7, 2024

(54) HEAVY DUTY ACTIVITY TABLE WITH MOUNTING GUSSET

(71) Applicant: NPS Public Furniture Corp., Clifton, NJ (US)

(72) Inventors: Alexander Crudo, Hoboken, NJ (US); Yehuda Freundlich, Passaic, NJ (US); Elliot Levy, Passaic, NJ (US)

(73) Assignee: NPS Public Furniture Corp., Clifton, NJ (US)

( * ) Notice: Subject to any disclaimer, the term of this patent is extended or adjusted under 35 U.S.C. 154(b) by 0 days.

(21) Appl. No.: 18/404,039

(22) Filed: Jan. 4, 2024

(51) Int. Cl.

| | |
|---|---|
| ***A47B 13/00*** | (2006.01) |
| ***A47B 9/00*** | (2006.01) |
| ***A47B 13/10*** | (2006.01) |
| ***A47B 96/20*** | (2006.01) |

(52) U.S. Cl.
CPC ..... *A47B 13/003* (2013.01); *A47B 9/00* (2013.01); *A47B 13/10* (2013.01); *A47B 96/206* (2013.01); *A47B 2200/005* (2013.01); *A47B 2220/0036* (2013.01)

(58) Field of Classification Search
CPC ..... A47B 13/003; A47B 13/10; A47B 13/021; A47B 13/02; A47B 9/00; A47B 96/206; A47B 2200/005; A47B 2200/0036; A47B 2013/022
USPC ..... 248/188; 108/153.1; 403/186
See application file for complete search history.

(56) References Cited

U.S. PATENT DOCUMENTS 3,590,753 A * 7/1971 Blink ..... F16B 12/52 248/188
3,636,894 A * 1/1972 Hage ..... A47B 3/06 248/188
4,128,222 A * 12/1978 Wiczer ..... F16B 12/46 248/188
4,727,816 A * 3/1988 Virtue ..... A47B 3/0912 108/155
4,745,867 A * 5/1988 Niemiec ..... A47B 13/021 248/188
4,846,079 A * 7/1989 Ajax ..... F16B 12/52 248/188

(Continued)

OTHER PUBLICATIONS

"Heavy-Duty Activity Tables," https://res.cloudinary.com/da3rom333/image/upload/v1699033710/Product%20Assets/Literature/Sell%20Sheets/SellSheet_NPS_Heavy_Duty_Activity_Tables_Series_txayaf_pdf. National Public Seating, Retrieved on Dec. 19, 2023.

(Continued)

*Primary Examiner* — Anita M King
(74) *Attorney, Agent, or Firm* — Weiss & Arons LLP

(57) ABSTRACT

An apparatus for mounting a table leg to a tabletop is provided. The apparatus may include a base. The apparatus may include a bracket. The apparatus may include a first support. The apparatus may include a second support. The base may be mounted to the tabletop via first holes defined in the base. The table leg may be mounted to the bracket. The bracket may include a U-shaped channel. The bracket may include a first wing. The bracket may include a second wing. The U-shaped channel may define a second hole to receive a bolt included in the table leg. The first wing may extend from an end of the U-shaped channel. The second wing may extend from an opposite end of the U-shaped channel. The wings may include third holes to receive screws to be mounted into the table leg. The supports may connect the base to the bracket.

20 Claims, 32 Drawing Sheets

(56) References Cited

U.S. PATENT DOCUMENTS

| | | | | | |
|---|---|---|---|---|---|
| 5,163,373 | A * | 11/1992 | Anderson | ..... | A47B 13/021 248/188 |
| 5,638,762 | A * | 6/1997 | Chestnutt | ..... | A47B 13/021 248/188.91 |
| 8,215,246 | B2 * | 7/2012 | Quam | ..... | E04H 3/28 108/159.11 |

OTHER PUBLICATIONS

"Virco Furniture and Equipment," Virco, Inc., 2021.
"5000 Series Table 30" x 60" Rectangle," https://virco.com/5000-series-table-30-x-60-rectangle, Virco Inc., 2022.
"4000 Series Table 30" x 60" Rectangle," https://virco.com/4000-series-table-30-x-60-rectangle, Virco Inc., 2022.
"Double Diamond Galaxy Table," https://www.columbiamfoinc.com/product/double~diamond-galaxy-table, Columbia, Mfg., Inc., Retrieved on Dec. 19, 2023.

* cited by examiner

HEAVY DUTY ACTIVITY TABLE WITH MOUNTING GUSSET

FIELD OF TECHNOLOGY

Aspects of the disclosure relate to functional mechanical designs, apparatus and methods of using the designs and apparatus. Specifically, aspects of the disclosure relate to apparatuses for mounting legs to tabletops with improved utility and performance.

BACKGROUND OF THE DISCLOSURE

Heavy duty activity tables may be useful for supporting a heavy load distributed over a tabletop. The heavy load may include books, computer equipment, machinery, lab equipment and any other items that may be placed on a tabletop.

Conventional heavy duty activity tables may be difficult to maneuver. Conventional heavy duty activity tables may be difficult to store. Conventional heavy duty activity tables may include foldable legs. Conventional heavy duty activity tables with foldable legs may have reduced usable seating due to folding mechanisms under the table. The folding mechanisms may add extra weight to the heavy duty activity tables, reducing maneuverability.

Conventional heavy duty activity tables may include removable legs. The connection between the removable leg and the table may be weak. The connection between the removable leg and the table may be easily pulled out when heavy weights are placed on the table. The removable legs may be specialized to prevent pulling out. The specialized legs may be expensive. The specialized legs may be difficult to manufacture. The specialized legs may be difficult to assemble. The specialized legs may require a tabletop capable of receiving the specialized legs.

Conventional heavy duty activity tables may require specialized tabletops. The specialized tabletops may include aprons or stabilizing bars for enhanced strength. Aprons or stabilizing bars may reduce the usable sitting area. Reducing the usable sitting area may interfere with wheelchairs attempting to reach the table.

It would be desirable, therefore, to provide apparatuses and methods for heavy duty activity tables that are easily assembled, disassembled and stored. It would be further desirable to use standard mass produced tabletops and table legs for heavy duty activity tables. It would be further desirable to maximize usable seating area for heavy duty activity tables. It would be further desirable to retrofit existing tabletops into heavy duty activity tables without requiring aprons or stabilizing bars. It would be further desirable to retrofit existing tabletops into heavy duty activity tables without risking the pulling out of the table legs when loaded.

SUMMARY OF THE DISCLOSURE

Aspects of the disclosure relate to methods for assembling a table. Aspects of the disclosure relate to an apparatus that mounts a table leg to a tabletop. The apparatus may include a base. The apparatus may include a bracket. The apparatus may include first and second supports.

The base may be mounted to the tabletop. The base may include holes defined in the base. The base may be mounted to the tabletop through inserting a fastener through the holes and into the tabletop.

The bracket may include a U-shaped channel. The bracket may include a first wing. The bracket may include a second wing. The first and second wings may extend from opposite ends of the U-shaped channel. The U-shaped channel may include a hole. The hole may accept a bolt included in the table leg.

The first and second wings may include holes. The holes may allow for the table leg to be mounted to the bracket. The table leg may be mounted to the bracket by inserting fasteners through the holes and into the table leg. The table leg may be mounted to the bracket such that sides of the table leg lie flat against inner surfaces of the first and second wings.

The first and second supports may connect the base to the bracket. The first support may connect an outer surface of the first wing to the base. The second support may connect an outer surface of the second wing to the base.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

DETAILED DESCRIPTION OF THE DISCLOSURE

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure.

Figure 1:
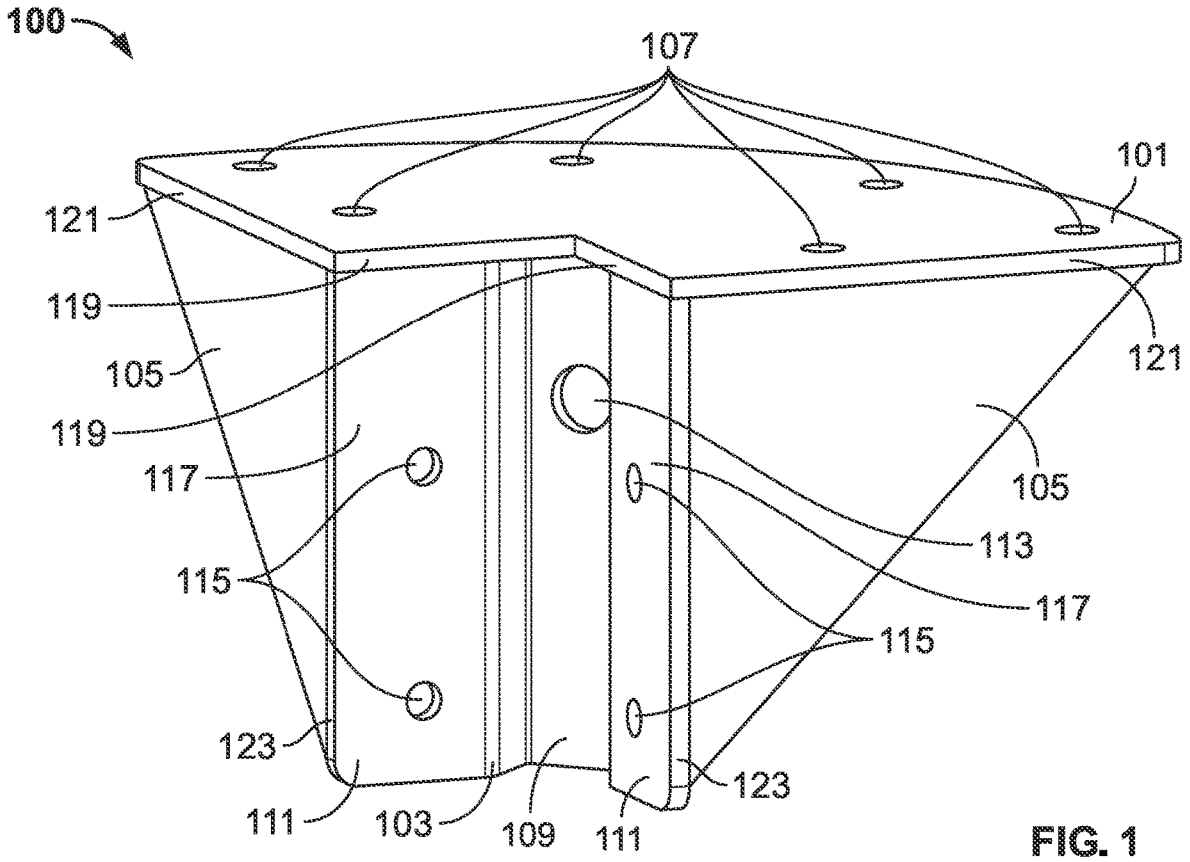
FIG. 1 shows an illustrative apparatus in accordance with principles of the disclosure.

FIG. 1 shows illustrative apparatus 100. Apparatus 100 may include one or more of base 101, bracket 103 and supports 105. Base 101 may include holes 107. Fasteners (see FIGS. 6-7 and discussion below) may be inserted into holes 107. Base 101 may be mounted to a tabletop (see FIGS. 8, 14, 20, 25, 30 and 36 discussed below) using the fasteners. There may be 4, 5, 6, 7 or any suitable number of holes 107. More fasteners may provide for increased mounting strength. More holes 107 in apparatus 100 may weaken apparatus 100. According to the principles of the invention in a preferred embodiment 6 holes and corresponding fasteners may provide maximum mounting strength while maintaining the strength of the apparatus.

Bracket 103 may include U-shaped channel 109. Bracket 103 may include wings 111. Wings 111 may extend from U-shaped channel 109. There may be a wing 111 on each side of U-shaped channel 109. U-shaped channel 109 may include hole 113. Bolt (see FIG. 5 and discussion below) may be inserted through hole 113. Bolt may be inserted through the open side of U-shaped channel 109.

Each wing 111 may include holes 115. A fastener (see FIGS. 6-7 and discussion below) may be inserted into holes 115. A table leg (see FIG. 5 and discussion below) may be mounted to bracket 103 using the fasteners. There may be 1, 2, 3 or any suitable number of holes 115. More fasteners may provide for increased mounting strength. More holes 115 in apparatus 100 may weaken apparatus 100. According to the principles of the invention in a preferred embodiment 2 holes and corresponding fasteners may provide maximum mounting strength while maintaining the strength of the apparatus.

Each wing 111 may include the same number of holes 115. Each wing 111 may include a different number of holes 115. In a preferred embodiment each wing has the same number of holes. Holes 115 of wing 111 may be positioned in the same location as holes 115 of opposing wing 111. Holes 115 of wing 111 may be positioned in the same vertical and horizontal axes as holes 115 of opposing wing 111 when assembled.

Each wing 111 may include inner surface 117. The table leg may lie flat against inner surface 117 when assembled. Inner surface 117 may be flush with edge 119 of base 101 when assembled.

Each support 105 may be connected to base 101. Each support 105 may be connected to bracket 103. Each support 105 may be connected by welding, brazing or using any other suitable connection. In a preferred embodiment, each support 105 is welded to base 101. In a preferred embodiment, each support 105 is welded to bracket 103. Inner surface 117 may be free from welding or brazing material. This may prevent obstructions between the table leg and bracket 103. Each support 105 may be flush with edge 121 of base 101 when assembled. Each support 105 may be flush with edge 123 of wings 111 when assembled.

Figure 2:
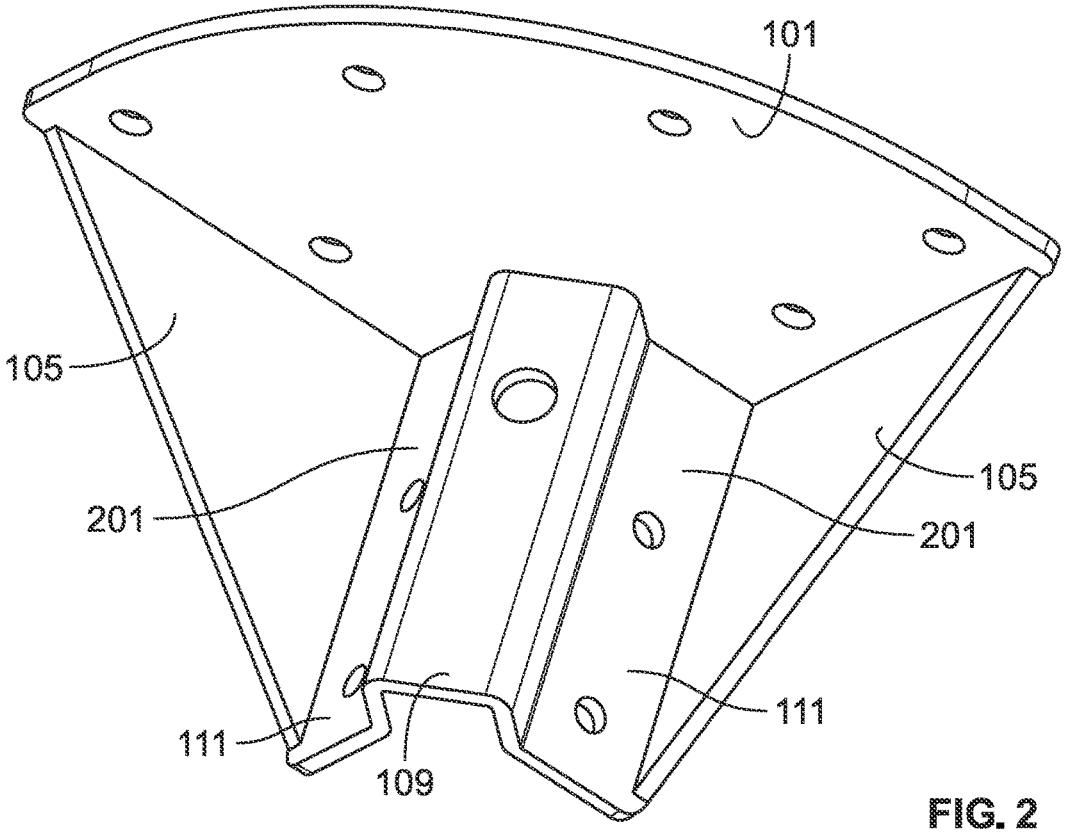
FIG. 2 shows another illustrative apparatus in accordance with principles of the disclosure.

FIG. 2 shows illustrative apparatus 100. Each wing may include outer surface 201. Each support 105 may be connected to outer surface 201 of wings 111. Each support may be welded to outer surface 201 of wings 111. Bracket 103 may be connected to base 101 only through supports 105. Bracket 103 may be directly connected to base 101. In a preferred embodiment bracket 103 is connected to base 101 only through supports 105.

Support 105 may be triangular, polygonal, semi-angular or any other suitable shape. In a preferred embodiment supports 105 are triangular. The connection between support 105 and base 101 may define a first side of a triangle. The connection between support 105 and bracket 103 may define a second side of the triangle.

Corners of base 101 shown in FIG. 2 may be rounded. Corners of bracket 103 shown in FIG. 2 may be rounded. Rounded corners may prevent accidental injuries by users touching the corners. Base 101 may overhang a corner of support 105. Bracket 103 may overhang a corner of support 105. The overhangs may prevent corners of support 105 from being accessible. Corners that will not be accessible after assembly with a tabletop and/or table leg, such as corners where edges 119 and 121 meet, may be unrounded. The inaccessible corners may be rounded.

Figure 3:
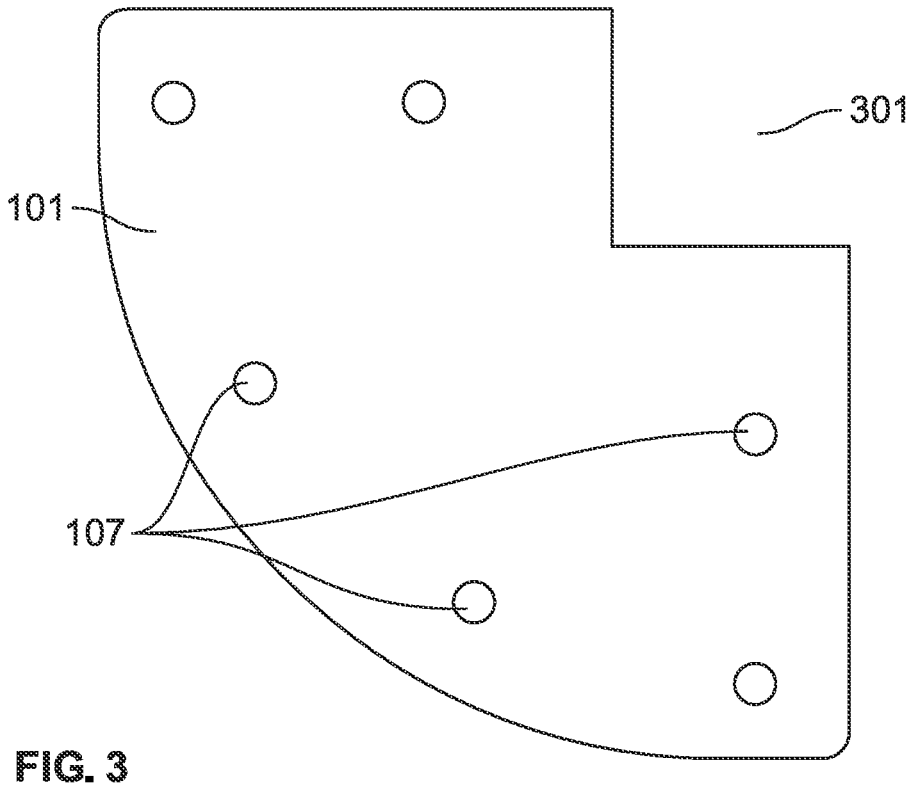
FIG. 3 shows another illustrative apparatus in accordance with principles of the disclosure.

FIG. 3 shows a top view of illustrative apparatus 100. Base 101 may include cutout 301. Cutout 301 may be sized to accommodate the table leg. Cutout 301 may define edges 119.

Figure 4:
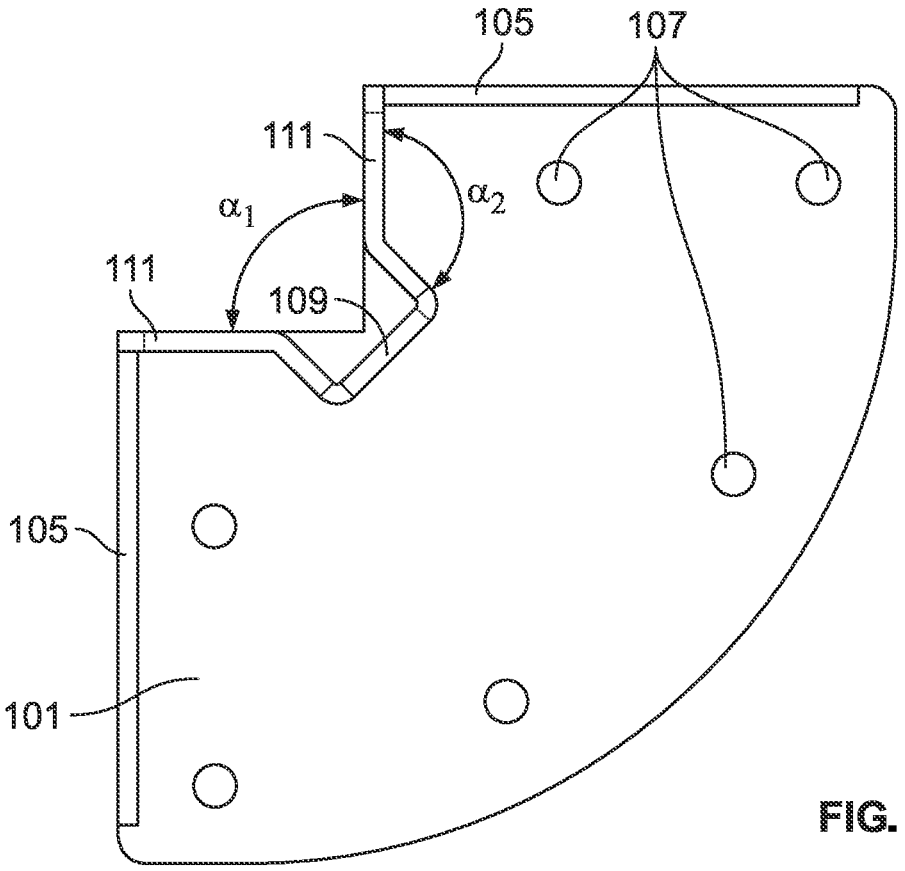
FIG. 4 shows another illustrative apparatus in accordance with principles of the disclosure.

FIG. 4 shows a bottom view of illustrative apparatus 100. Sides of U-shaped channel 109 may be parallel to each other. Sides of U-shaped channel 109 may be askew from each other. A length and width of wings 111 and a depth of U-shaped channel 109 may be sized to accommodate the table leg. Wings 111 may be positioned away from each other at angle $\alpha_1$. Angle $\alpha_1$ may be sized to accommodate the table leg. Angle $\alpha_1$ may be 80, 85, 90, 95, 100 or any other suitable number of degrees. Wings 111 may be positioned away from U-shaped channel 109 at angle $\alpha_2$. Angle $\alpha_2$ may be 125, 130, 135, 140, 145 or any other suitable number of degrees.

Illustrative apparatus 100 may be formed of steel. Apparatus 100 may be formed of 11 gauge steel, 12 gauge steel or any other suitable material. Apparatus 100 may be powder coated, spray painted or given any other suitable rust-proof finish. Apparatus 100 may be powder coated after welding. Apparatus 100 may be spray painted after welding.

Figure 5:
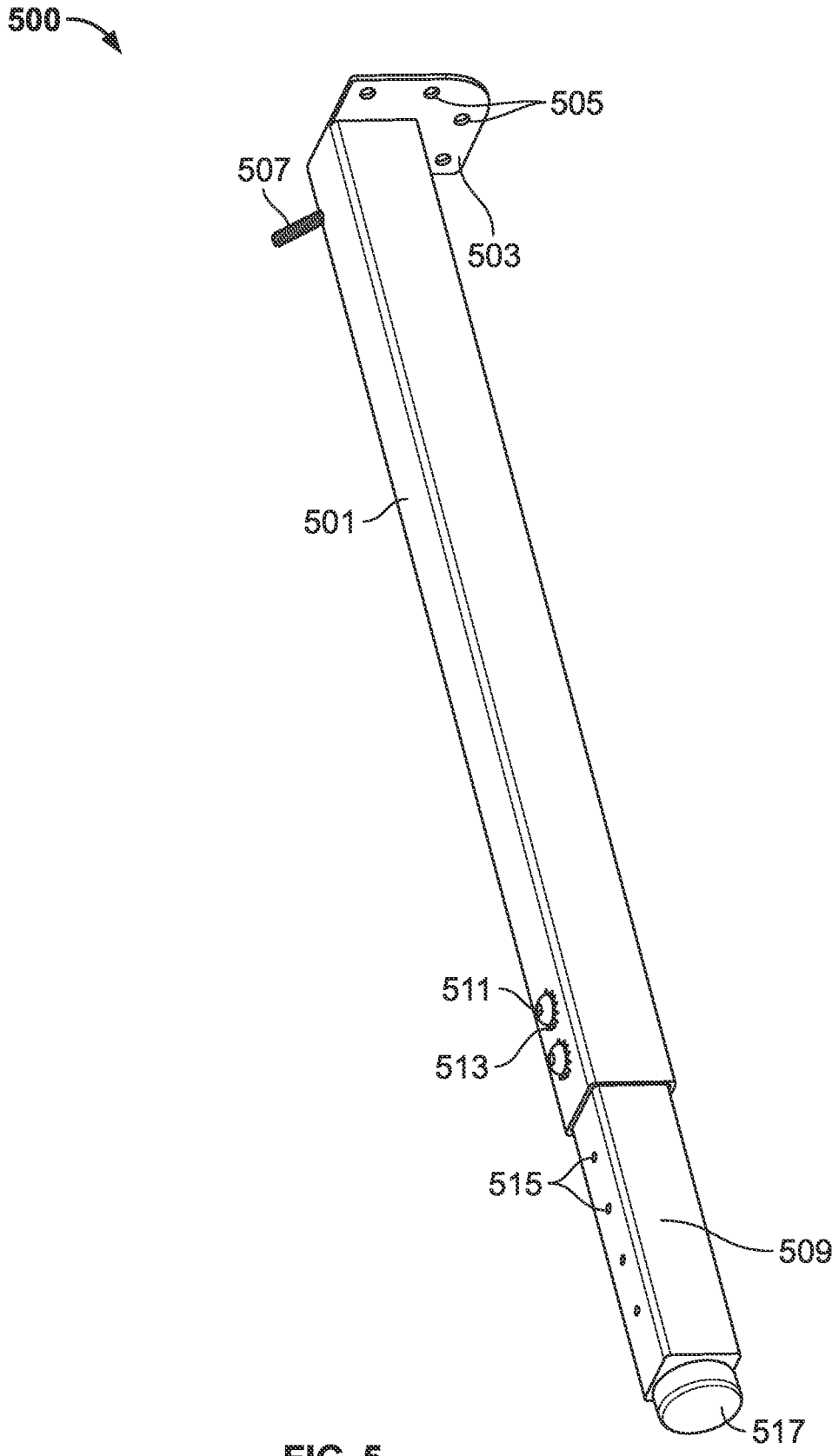
FIG. 5 shows another illustrative apparatus in accordance with principles of the disclosure.

FIG. 5 shows illustrative table leg 500. Table leg 500 may include upper tube 501. Upper tube 501 may include top plate 503. Top plate 503 may be mounted to a tabletop. Top plate 503 may include holes 505. Fasteners may be inserted through holes 505 to mount top plate 503 to the tabletop. Upper tube 501 may include bolt 507. Bolt 507 may be threaded. Bolt 507 may be sized to fit into hole 113. Table leg 500 may be mounted to apparatus 100 via bolt 507. A nut may be used to tighten around bolt 507 after being inserted into hole 113.

The distance between a center of bolt 507 and the top of top plate 503 may be the same as the distance between a center of hole 113 and the top of base 101. This distance may allow for both base 101 and top plate 503 to be flat against the tabletop when table leg 500 is mounted to apparatus 100 via bolt 507 and hole 113. The distance may be 23, 24, 25, 26 or any suitable number of millimeters. In a preferred embodiment the distance is 25 mm.

Table leg 500 may include lower tube 509. Lower tube 509 may be secured to upper tube 501. Lower tube 509 may be secured to upper tube 501 in different locations to adjust the height of table leg 500. Lower tube 509 may be secured to upper tube 501 via adjustment screw 511, adjustment lock washer 513 and adjustment holes 515. Adjustment screw 511 may be inserted through a hole in upper tube 501 and through one of the adjustment holes 515 in lower tube 509. Adjustment lock washer 513 may be interposed between adjustment screw 511 and upper tube 501. Inserting and tightening adjustment screw 511 through one of adjustment holes 515 may set the height of table leg 500.

There may be 1, 2, 3 or any suitable number of adjustment screws 511 and corresponding adjustment lock washers 513. There may be 6, 7, 8, 9, 10 or any suitable number of adjustment holes 515. Each adjustment hole 515 may be spaced a distance apart from each other. The distance may be a set distance between each adjustment hole 515. The distance may vary between adjustment holes 515. In a preferred embodiment the distance is a set distance. In a preferred embodiment the distance is 1 inch.

Lower tube 509 may include leg glider 517. Leg glider 517 may allow table leg 500 to glide across a surface. Table leg 500 may be formed of steel. Table leg 500 may be formed of 11 gauge steel, 12 gauge steel or any other suitable material. Table leg 500 may be powder coated, spray painted or given any other suitable rust-proof finish. Table leg 500 may be powder coated after welding. Table leg 500 may be spray painted after welding.

Figure 6:
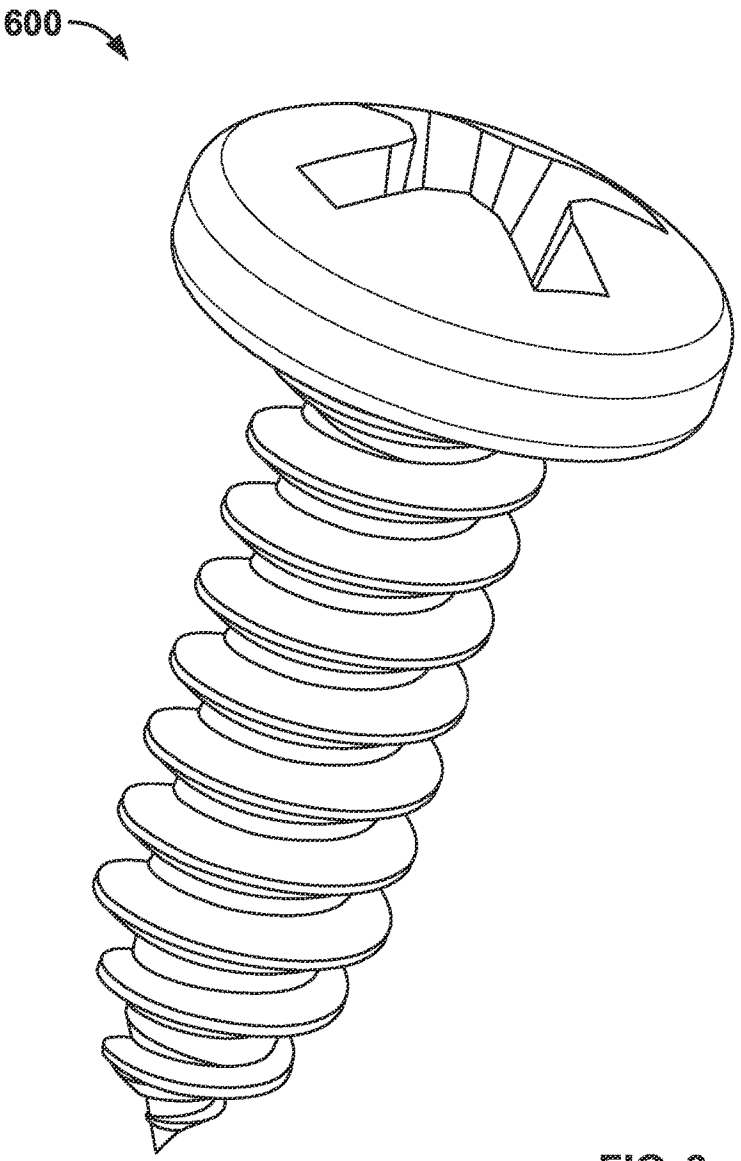
FIG. 6 shows another illustrative apparatus in accordance with principles of the disclosure.

FIG. 6 shows illustrative screw 600. Screw 600 may include any suitable diameter. Screw 600 may include any suitable pitch. Screw 600 may include any suitable head. Screw 600 may include any suitable length. Screw 600 may be the illustrative screw inserted into holes 107 to mount base 101 to a tabletop. Screw 600 may be the illustrative screw inserted into holes 505 to mount top plate 503 to the tabletop. Screw 600 may be designed to be screwed into wood, particleboard, cork or plastic tabletops.

Figure 7:
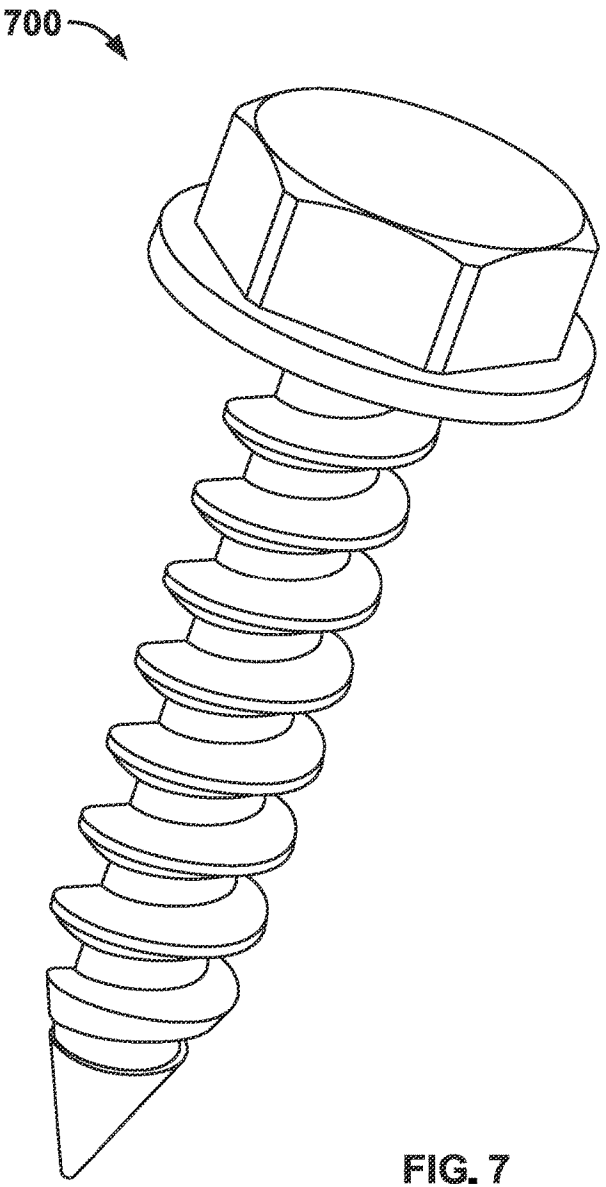
FIG. 7 shows another illustrative apparatus in accordance with principles of the disclosure.

FIG. 7 shows illustrative screw 700. Screw 700 may include any suitable diameter. Screw 700 may include any suitable pitch. Screw 700 may include any suitable head. Screw 700 may include any suitable length. Screw 700 may be self-tapping. Screw 700 may be the illustrative screw inserted into holes 115 to mount table leg 500 to bracket 103. Screw 700 may be designed to be screwed into metal table leg 500.

Table leg 500 may be suitable for use with mounts other than apparatus 100. Table leg 500 may be connected to mounts without screws. Table leg 500 may be manufactured without holes corresponding to holes 115. Mounting table leg 500 to apparatus 100 may include screwing screws 700 into upper tube 501. Screwing screws 700 into upper tube 501 may create holes in upper tube 501. For low load situations only bolt 507 and nut may be used to mount table leg 500 to apparatus 100. Screwing screws 700 through holes 115 and into upper tube 501 may enhance strength of the connection between table leg 500 and apparatus 100.

Figure 8:
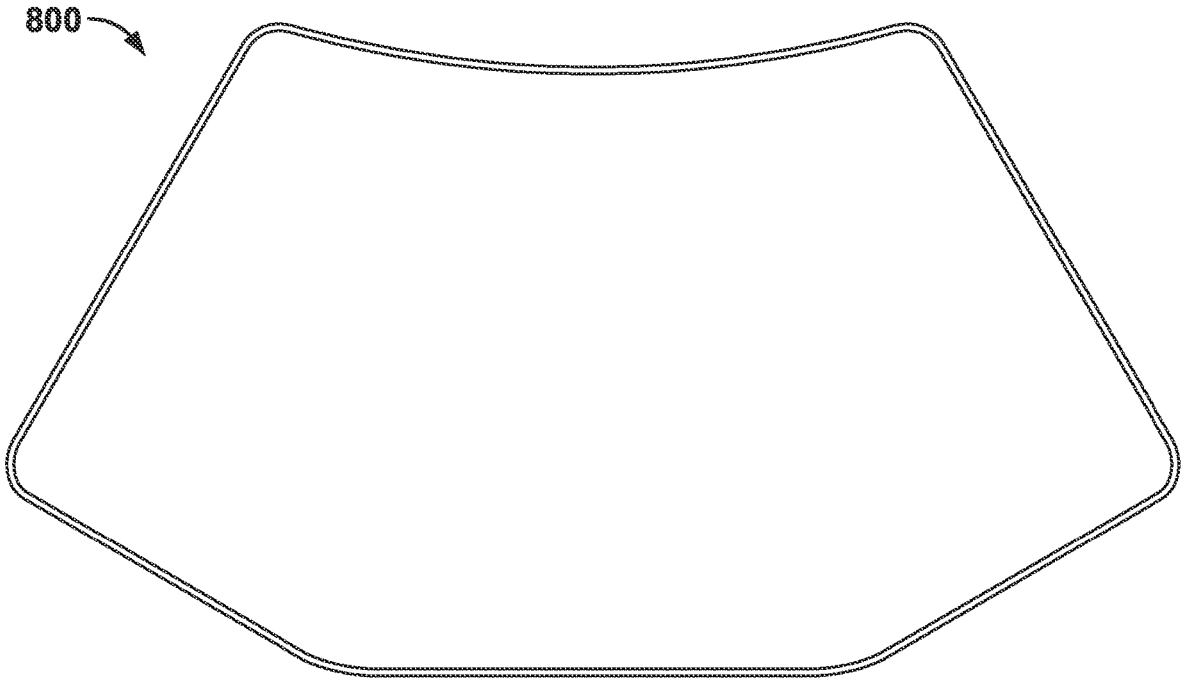
FIG. 8 shows another illustrative apparatus in accordance with principles of the disclosure.

FIG. 8 shows illustrative table 800. FIG. 8 shows a top view of table 800. Table 800 may include a semi-angular shape. Table 800 may include a particleboard core, a wood core, a plastic core, a metal core or any other suitable core. In a preferred embodiment table 800 includes a particleboard core. Table 800 may include a tabletop. Tabletop may include a top surface and a bottom surface. Top surface may include one of a high pressure laminate, a whiteboard, a chemical resistant top or any other suitable surface finish. Bottom surface may omit a surface finish. Bottom surface may include the same surface finish as the top surface. Bottom surface may include a different surface finish as the top surface. Tabletop may omit edge banding. Tabletop may include edge banding. Edge banding may include PVC edge banding, T-molding, chemical resistant edge banding or any other suitable edge banding.

Figure 9:
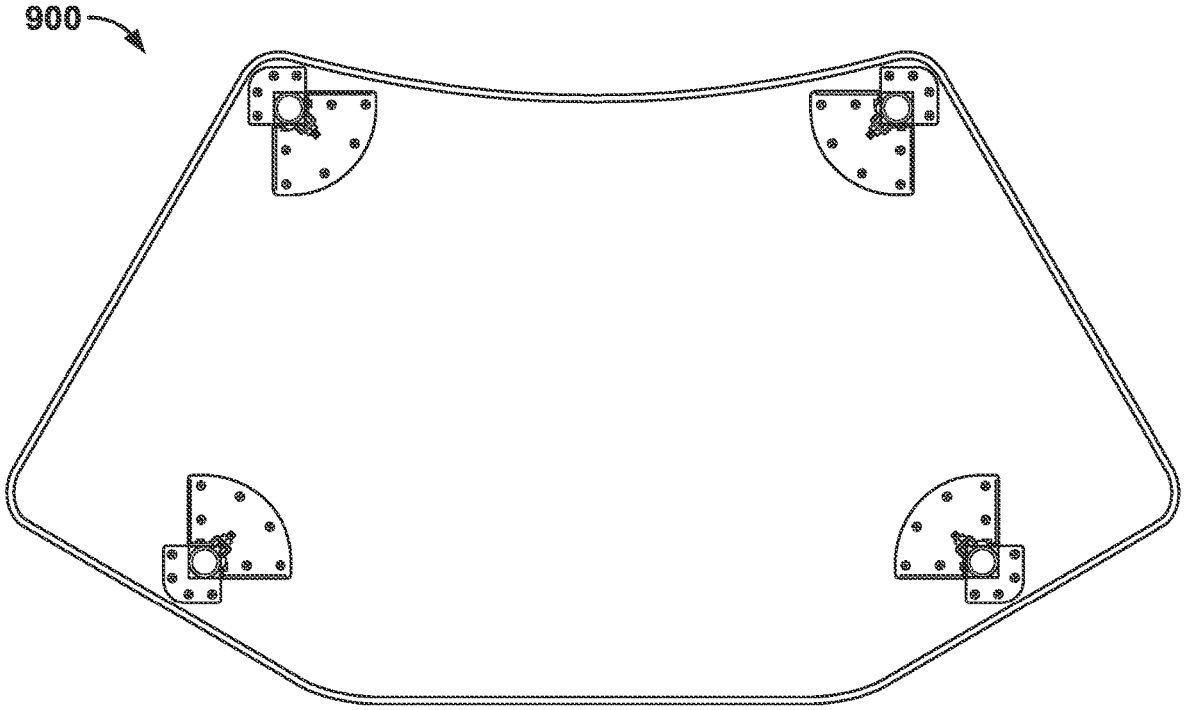
FIG. 9 shows another illustrative apparatus in accordance with principles of the disclosure.

FIG. 9 shows illustrative table 900. FIG. 9 may show a bottom view of table 900. FIG. 9 may show a bottom view of table 800. Table 900 may include 4 apparatuses. Table 900 may include 4 table legs. Apparatuses may be similar to apparatus 100 described in detail above. Table legs may be similar to table leg 500 described in detail above.

Figure 10:
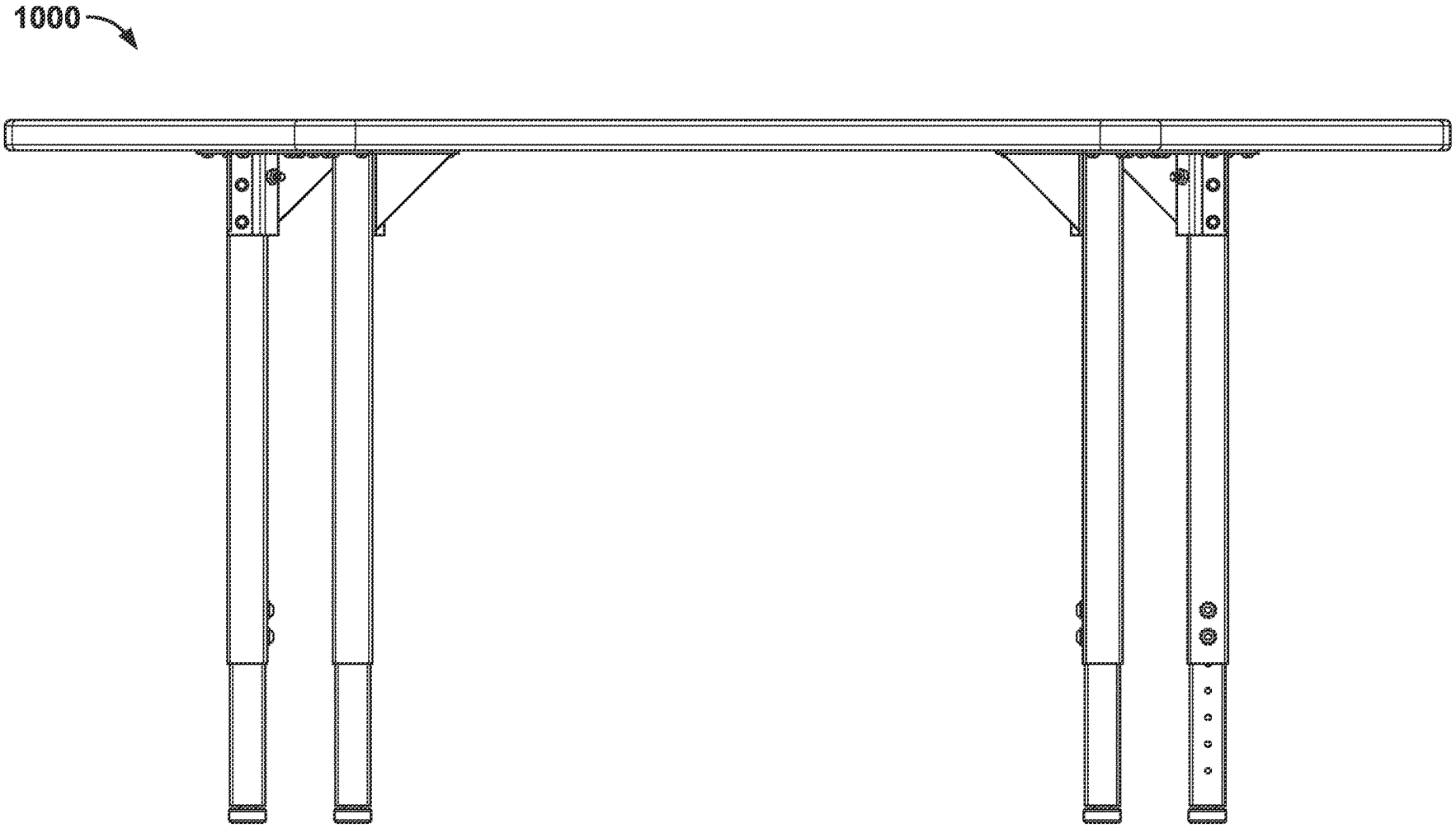
FIG. 10 shows another illustrative apparatus in accordance with principles of the disclosure.

FIG. 10 shows illustrative table 1000. FIG. 10 may show a side view of table 1000. FIG. 10 may show a side view of table 800.

Figure 11:
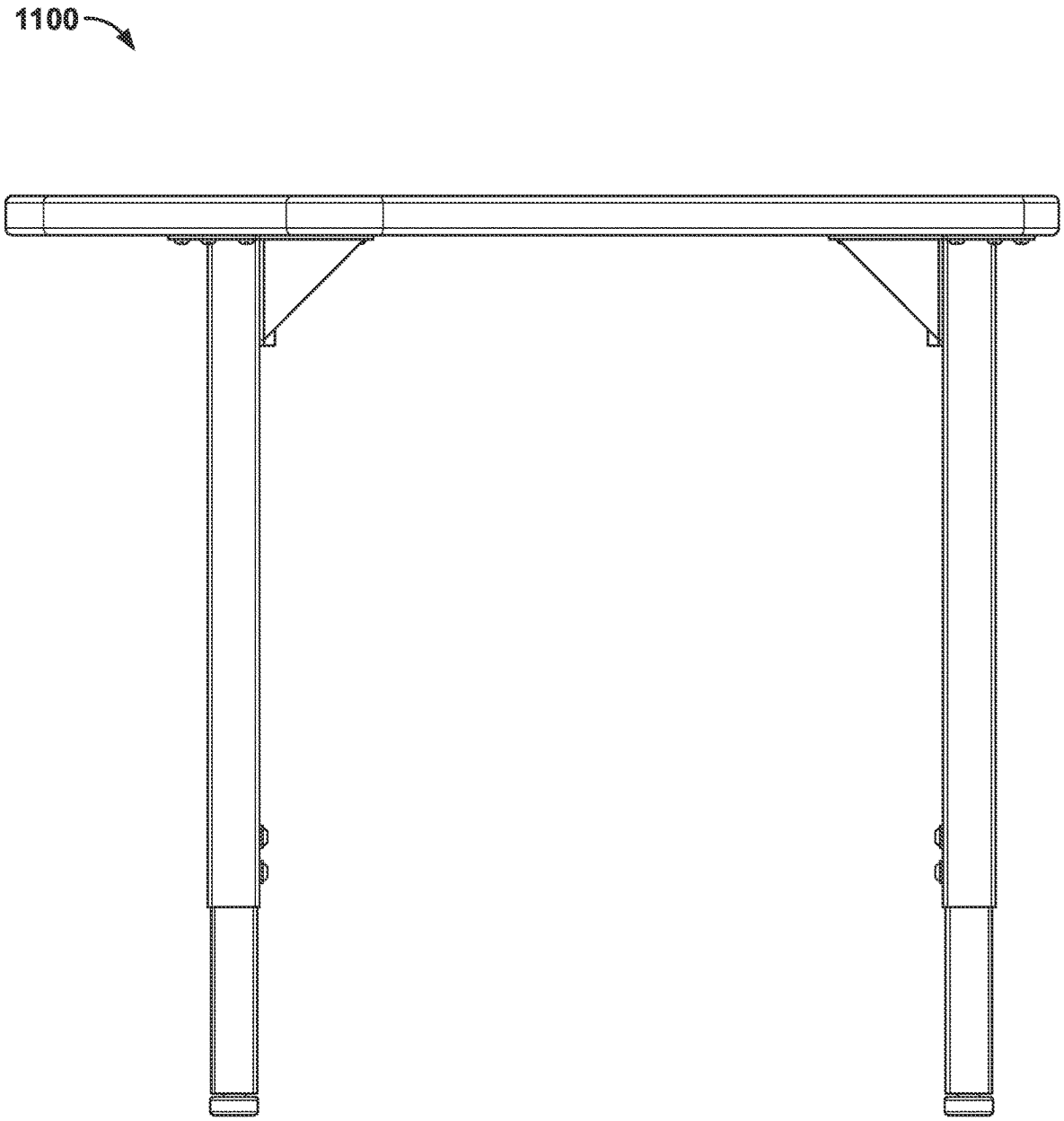
FIG. 11 shows another illustrative apparatus in accordance with principles of the disclosure.

FIG. 11 shows illustrative table 1100. FIG. 11 may show a side view of table 1100. FIG. 11 may show another side view of table 800.

Figure 12:
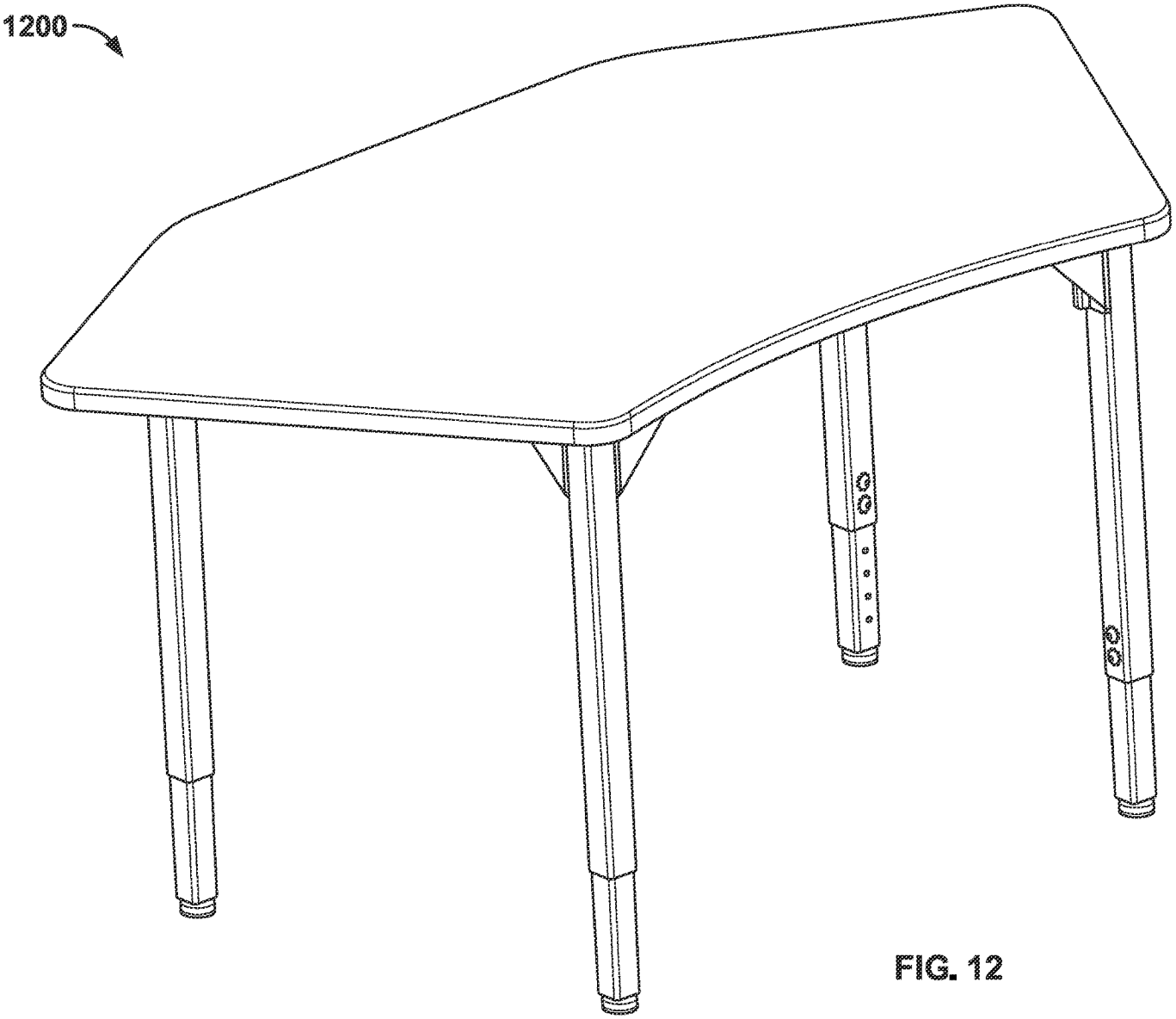
FIG. 12 shows another illustrative apparatus in accordance with principles of the disclosure.

FIG. 12 shows illustrative table 1200. FIG. 12 may show a top skewed view of table 1200. FIG. 12 may show a top skewed view of table 800.

Figure 13:
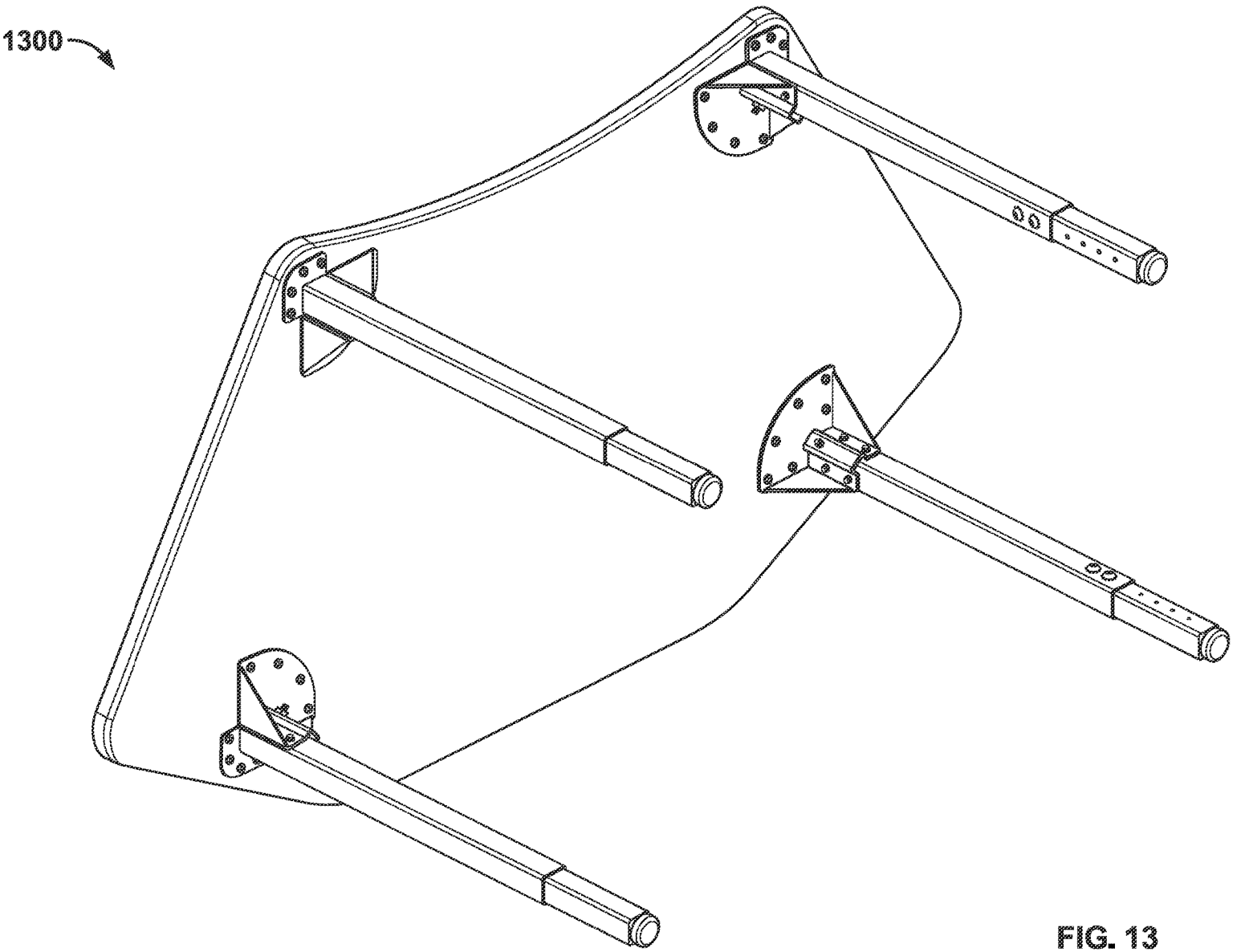
FIG. 13 shows another illustrative apparatus in accordance with principles of the disclosure.

FIG. 13 shows illustrative table 1300. FIG. 13 may show a bottom skewed view of table 1300. FIG. 13 may show a bottom skewed view of table 800.

Figure 14:
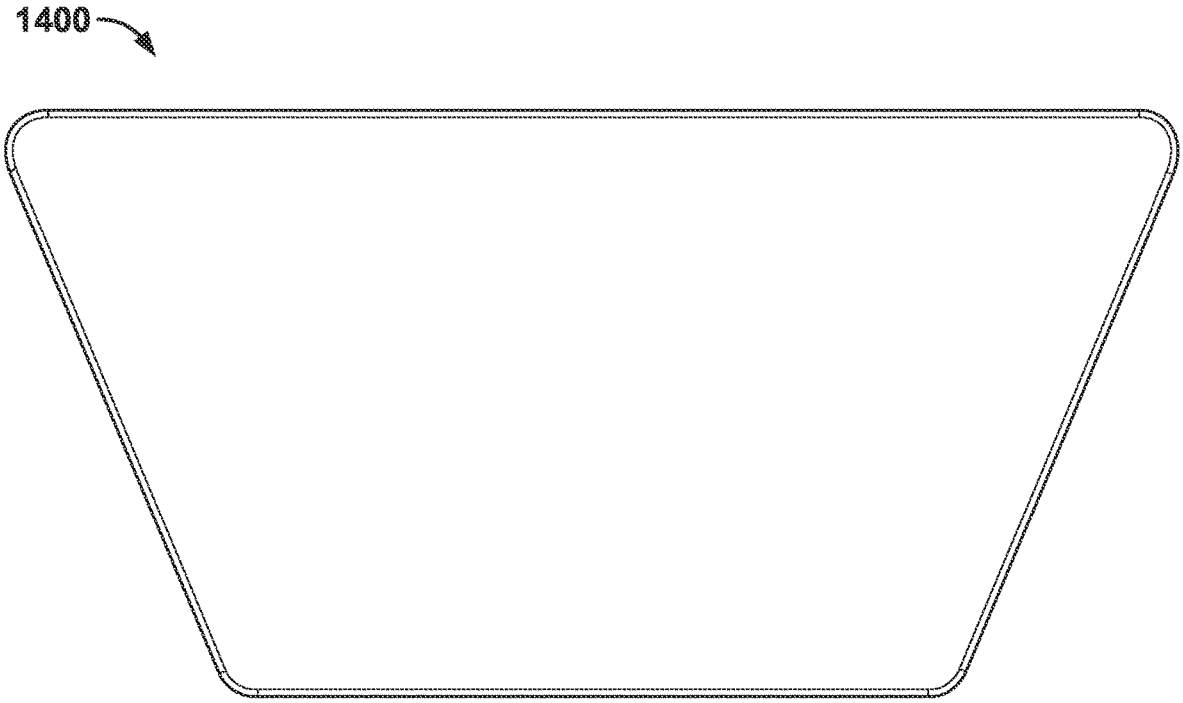
FIG. 14 shows another illustrative apparatus in accordance with principles of the disclosure.

FIG. 14 shows illustrative table 1400. FIG. 14 shows a top view of table 1400. Table 1400 may include a trapezoidal shape. Table 1400 may include a particleboard core, a wood core, a plastic core, a metal core or any other suitable core. In a preferred embodiment table 1400 includes a particleboard core. Table 1400 may include a tabletop. Tabletop may include a top surface and a bottom surface. Top surface may include one of a high pressure laminate, a whiteboard, a chemical resistant top or any other suitable surface finish. Bottom surface may omit a surface finish. Bottom surface may include the same surface finish as the top surface. Bottom surface may include a different surface finish as the top surface. Tabletop may omit edge banding. Tabletop may include edge banding. Edge banding may include PVC edge banding, T-molding, chemical resistant edge banding or any other suitable edge banding.

Figure 15:
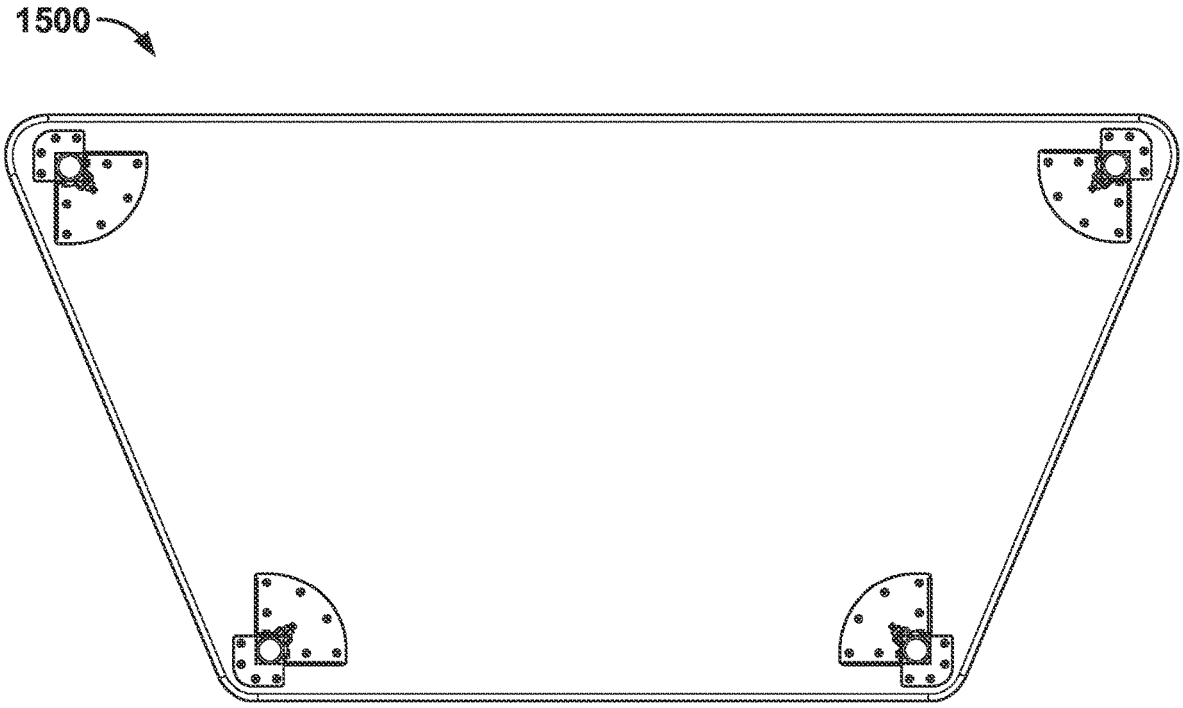
FIG. 15 shows another illustrative apparatus in accordance with principles of the disclosure.

FIG. 15 shows illustrative table 1500. FIG. 15 may show a bottom view of table 1500. FIG. 15 may show a bottom view of table 1400. Table 1500 may include 4 apparatuses. Table 1500 may include 4 table legs. Apparatuses may be similar to apparatus 100 described in detail above. Table legs may be similar to table leg 500 described in detail above.

Figure 16:
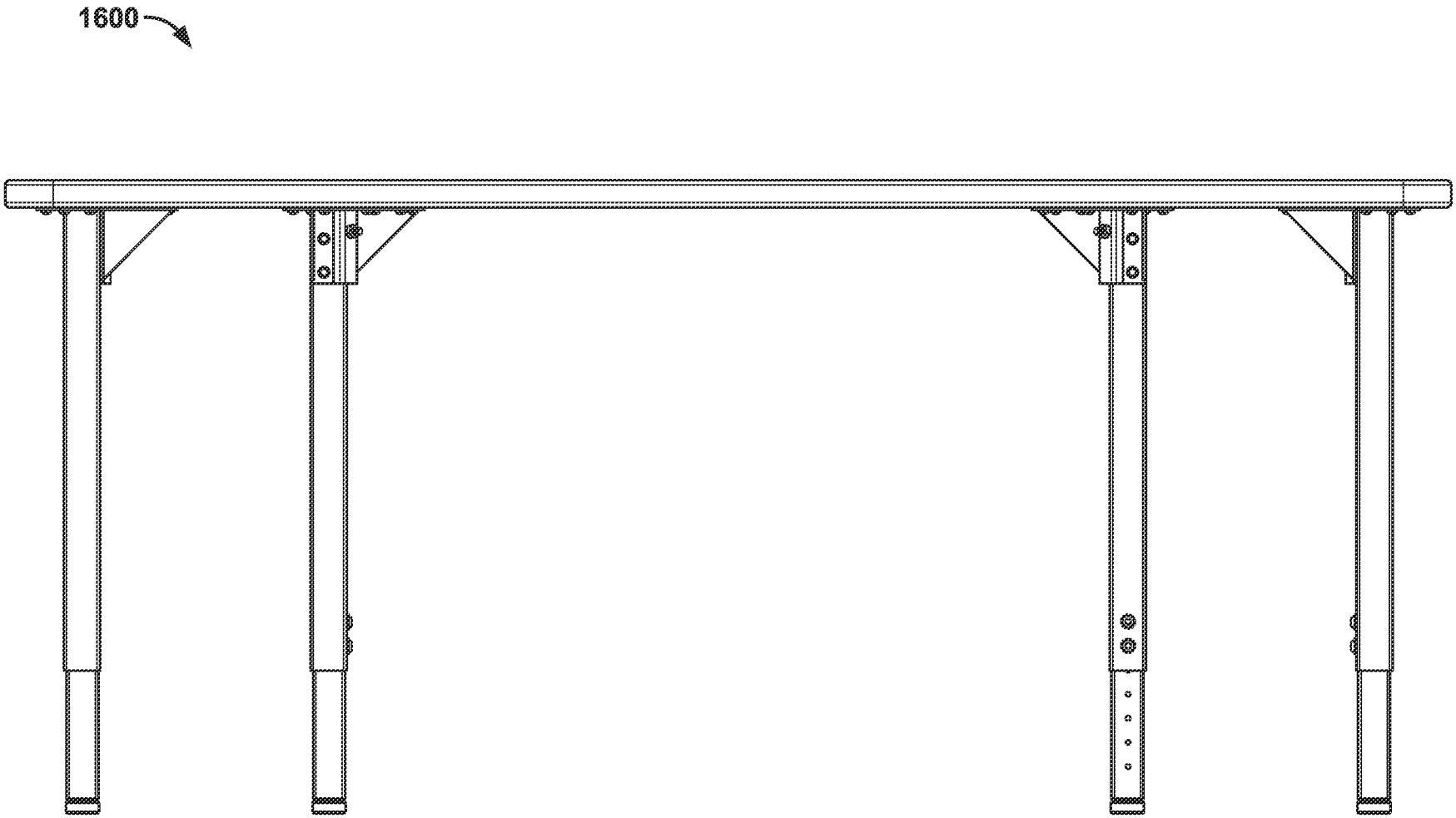
FIG. 16 shows another illustrative apparatus in accordance with principles of the disclosure.

FIG. 16 shows illustrative table 1600. FIG. 16 may show a side view of table 1600. FIG. 16 may show a side view of table 1400.

Figure 17:
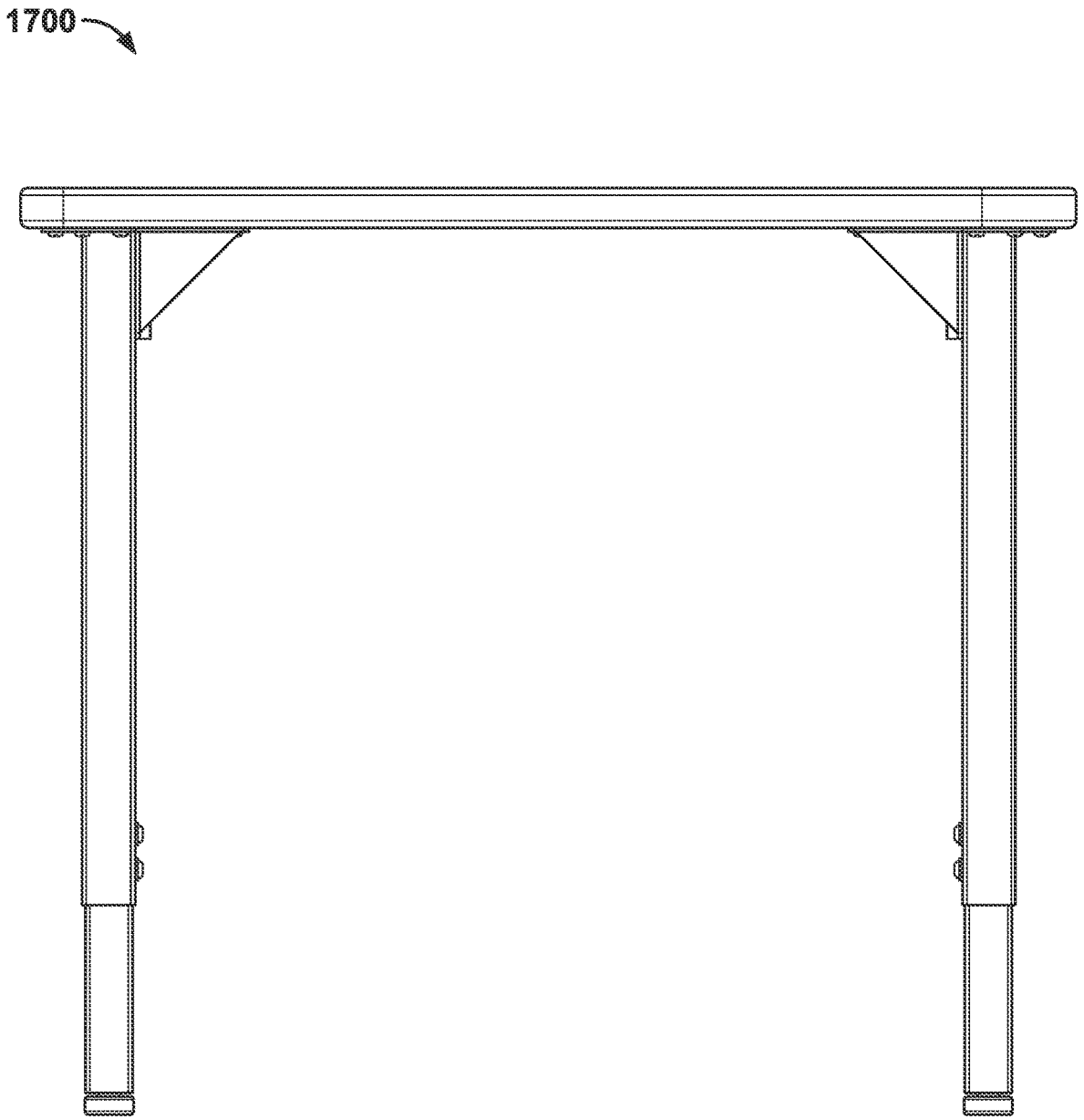
FIG. 17 shows another illustrative apparatus in accordance with principles of the disclosure.

FIG. 17 shows illustrative table 1700. FIG. 17 may show a side view of table 1700. FIG. 17 may show another side view of table 1400.

Figure 18:
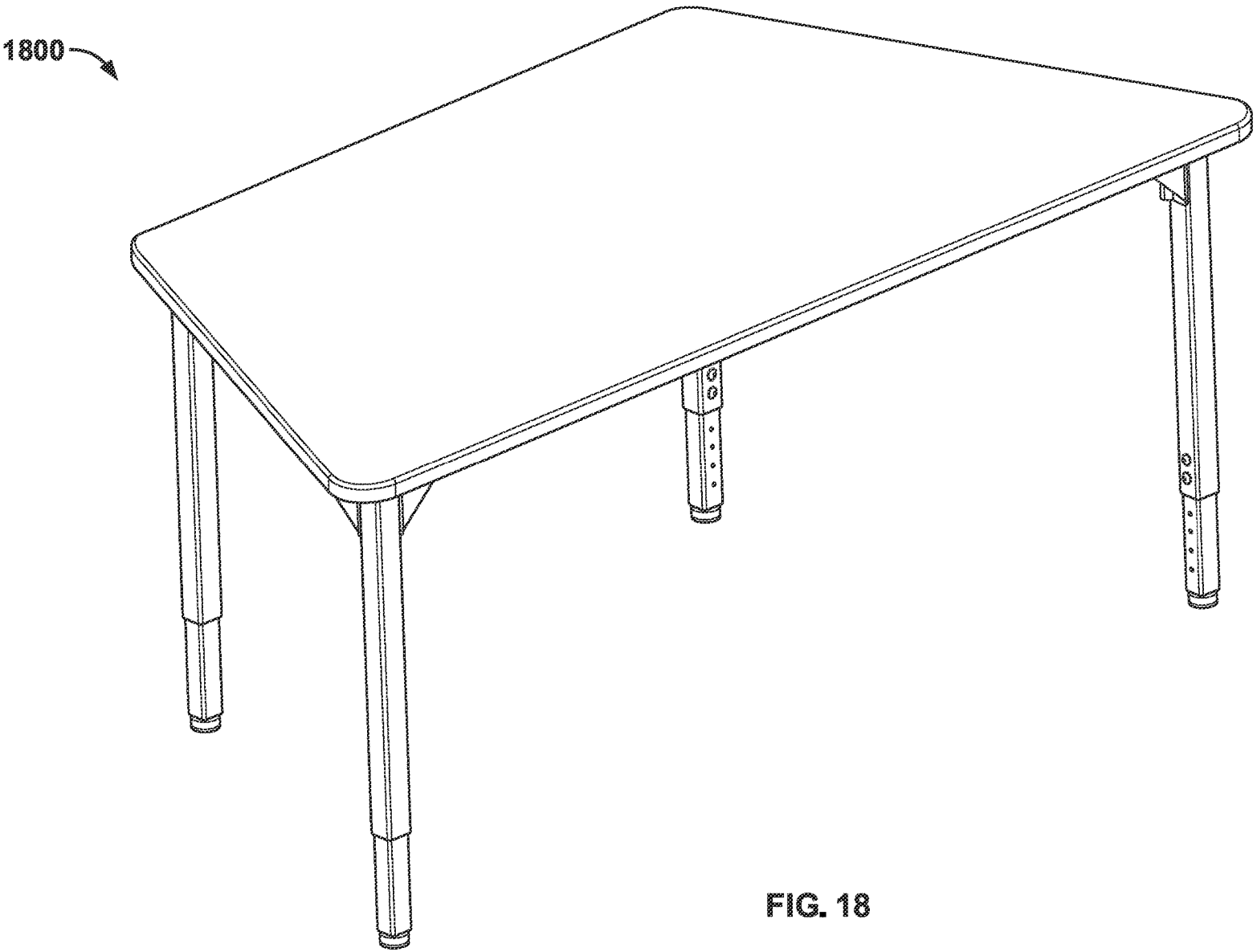
FIG. 18 shows another illustrative apparatus in accordance with principles of the disclosure.

FIG. 18 shows illustrative table 1800. FIG. 18 may show a top skewed view of table 1800. FIG. 18 may show a top skewed view of table 1400.

Figure 19:
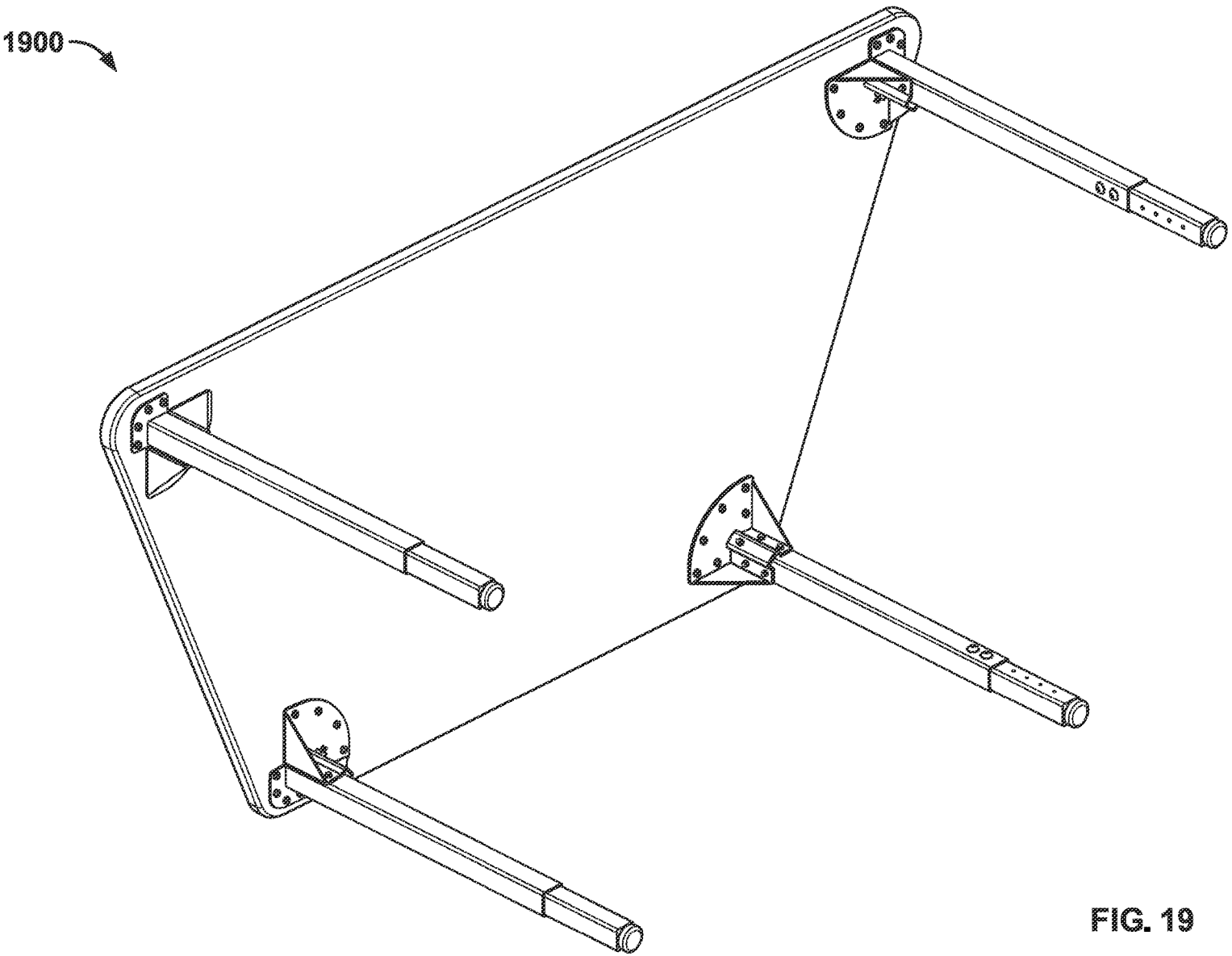
FIG. 19 shows another illustrative apparatus in accordance with principles of the disclosure.

FIG. 19 shows illustrative table 1900. FIG. 19 may show a bottom skewed view of table 1900. FIG. 19 may show a bottom skewed view of table 1400.

Figure 20:
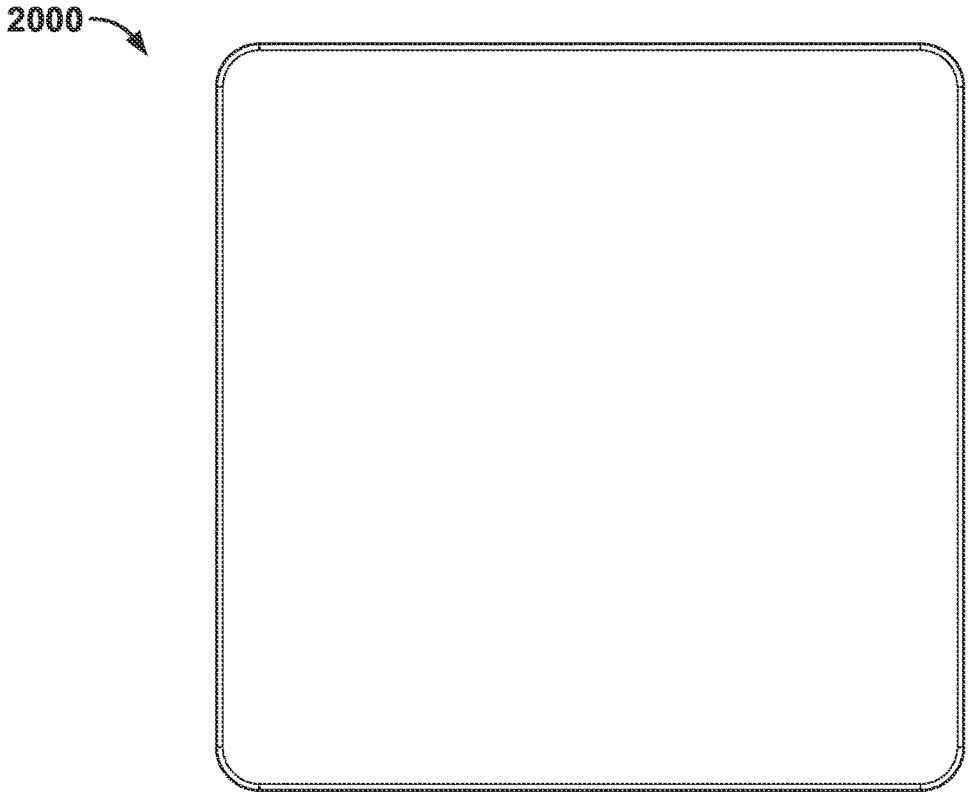
FIG. 20 shows another illustrative apparatus in accordance with principles of the disclosure.

FIG. 20 shows illustrative table 2000. FIG. 20 shows a top view of table 2000. Table 2000 may include a square shape. Table 2000 may include a particleboard core, a wood core, a plastic core, a metal core or any other suitable core. In a preferred embodiment table 2000 includes a particleboard core. Table 2000 may include a tabletop. Tabletop may include a top surface and a bottom surface. Top surface may include one of a high pressure laminate, a whiteboard, a chemical resistant top or any other suitable surface finish. Bottom surface may omit a surface finish. Bottom surface may include the same surface finish as the top surface. Bottom surface may include a different surface finish as the top surface. Tabletop may omit edge banding. Tabletop may include edge banding. Edge banding may include PVC edge banding, T-molding, chemical resistant edge banding or any other suitable edge banding.

Figure 21:
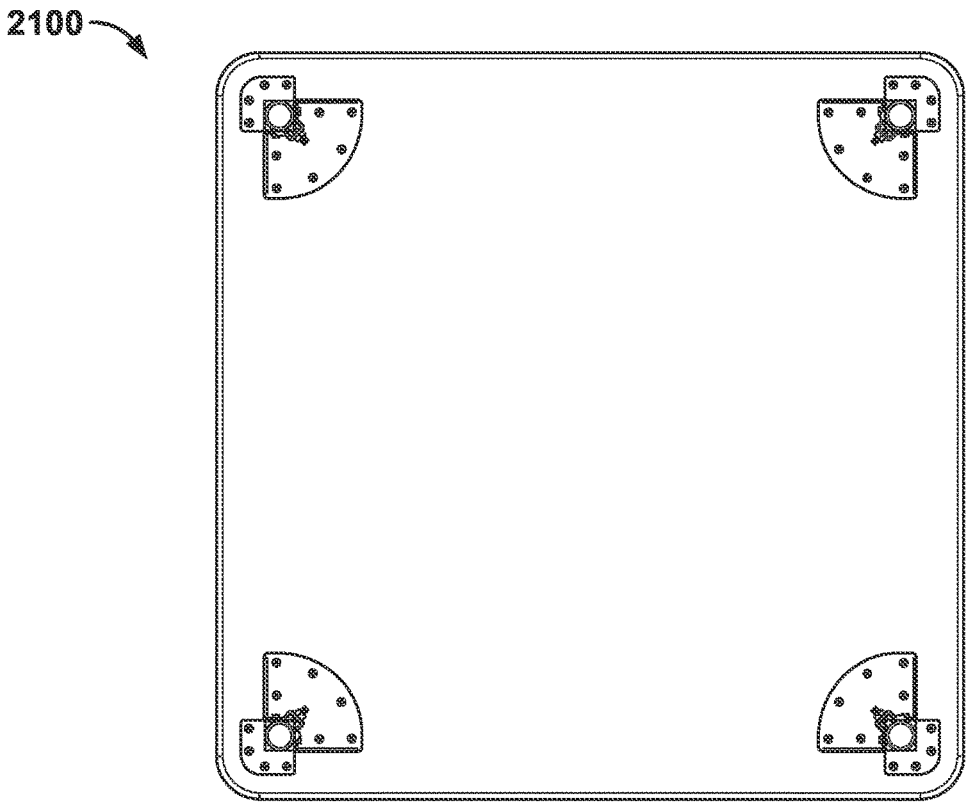
FIG. 21 shows another illustrative apparatus in accordance with principles of the disclosure.

FIG. 21 shows illustrative table 2100. FIG. 21 may show a bottom view of table 2100. FIG. 21 may show a bottom view of table 2000. Table 2100 may include 4 apparatuses. Table 2100 may include 4 table legs. Apparatuses may be similar to apparatus 100 described in detail above. Table legs may be similar to table leg 500 described in detail above.

Figure 22:
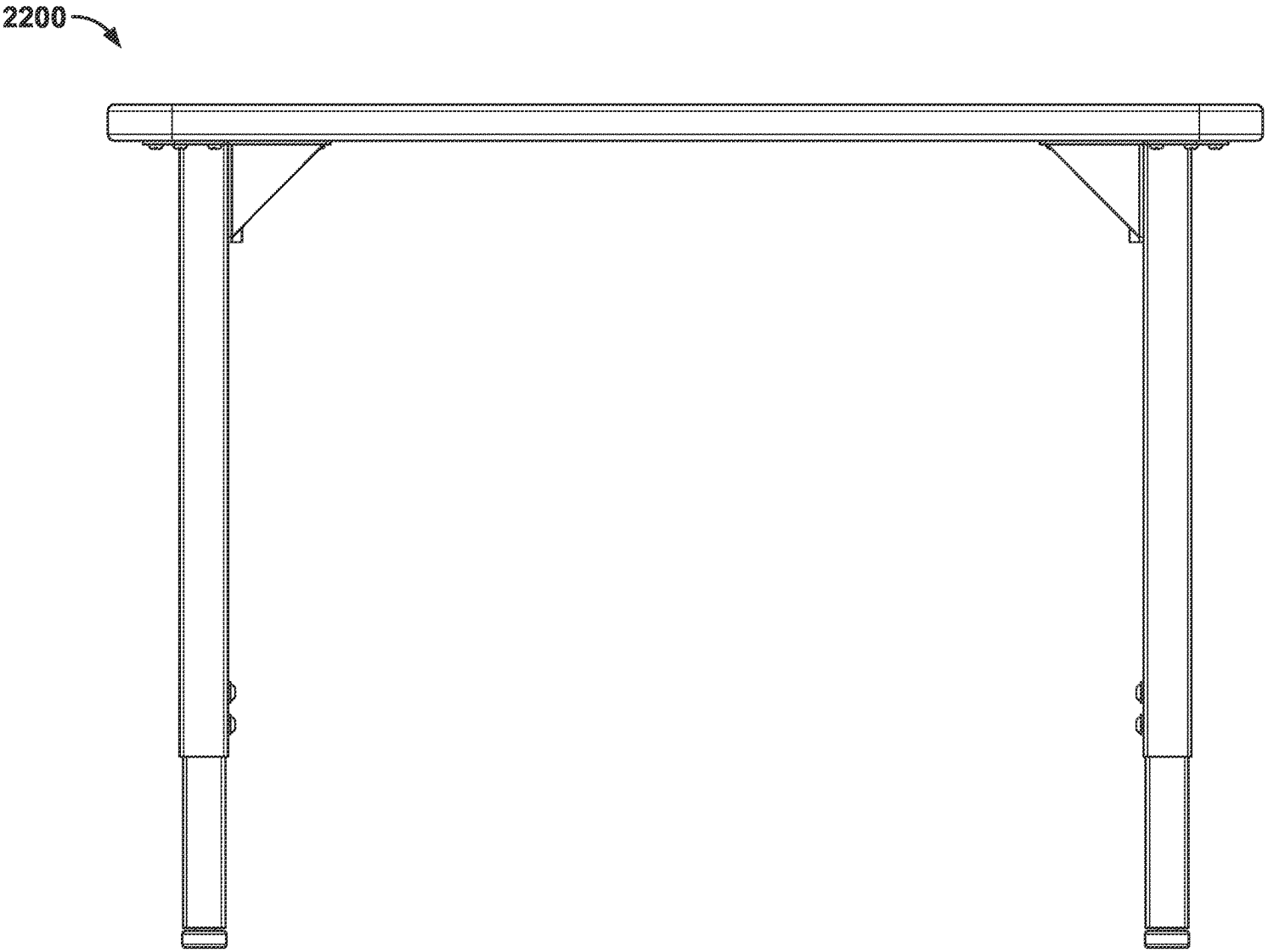
FIG. 22 shows another illustrative apparatus in accordance with principles of the disclosure.

FIG. 22 shows illustrative table 2200. FIG. 22 may show a side view of table 2200. FIG. 22 may show a side view of table 2000.

Figure 23:
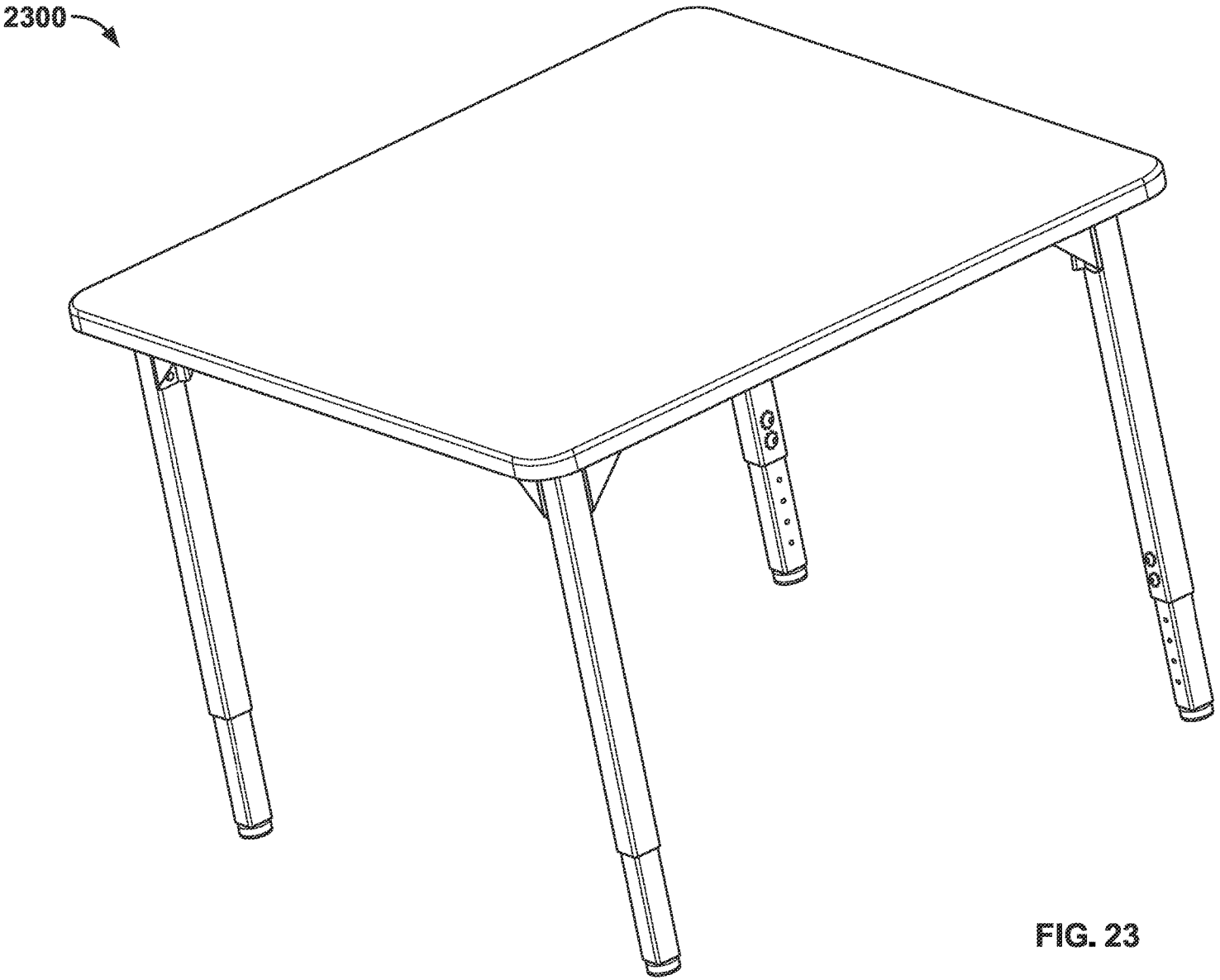
FIG. 23 shows another illustrative apparatus in accordance with principles of the disclosure.

FIG. 23 shows illustrative table 2300. FIG. 23 may show a top skewed view of table 2300. FIG. 23 may show a top skewed view of table 2000.

Figure 24:
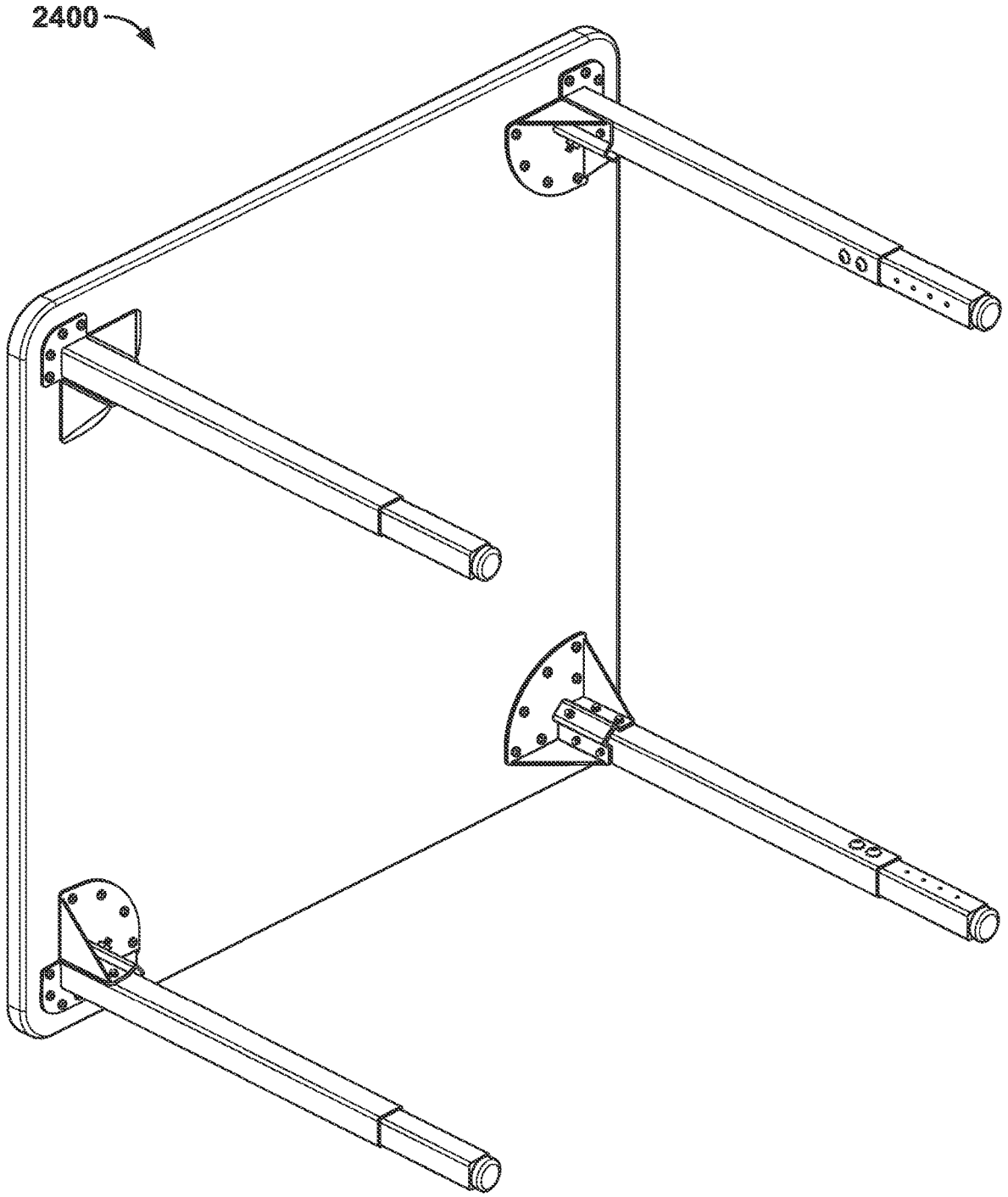
FIG. 24 shows another illustrative apparatus in accordance with principles of the disclosure.

FIG. 24 shows illustrative table 2400. FIG. 24 may show a bottom skewed view of table 2000. FIG. 24 may show a bottom skewed view of table 2000.

Figure 25:
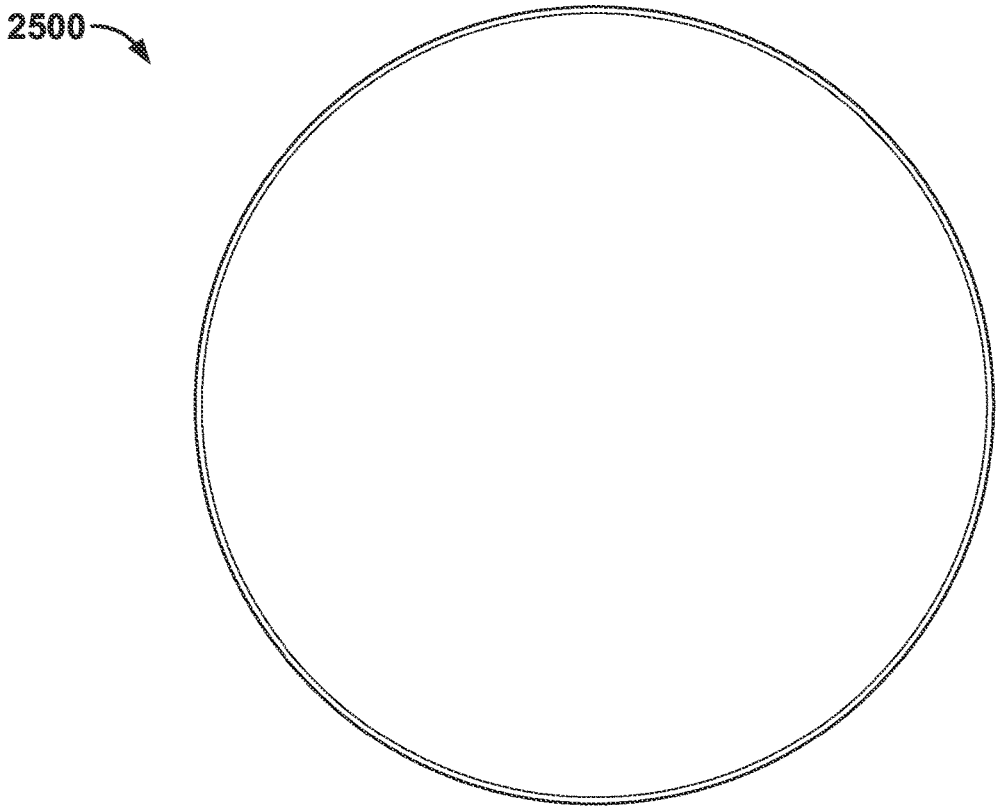
FIG. 25 shows another illustrative apparatus in accordance with principles of the disclosure.

FIG. 25 shows illustrative table 2500. FIG. 25 shows a top view of table 2500. Table 2500 may include a circular shape. Table 2500 may include a particleboard core, a wood core, a plastic core, a metal core or any other suitable core. In a preferred embodiment table 2500 includes a particleboard core. Table 2500 may include a tabletop. Tabletop may include a top surface and a bottom surface. Top surface may include one of a high pressure laminate, a whiteboard, a chemical resistant top or any other suitable surface finish. Bottom surface may omit a surface finish. Bottom surface may include the same surface finish as the top surface. Bottom surface may include a different surface finish as the top surface. Tabletop may omit edge banding. Tabletop may include edge banding. Edge banding may include PVC edge banding, T-molding, chemical resistant edge banding or any other suitable edge banding.

Figure 26:
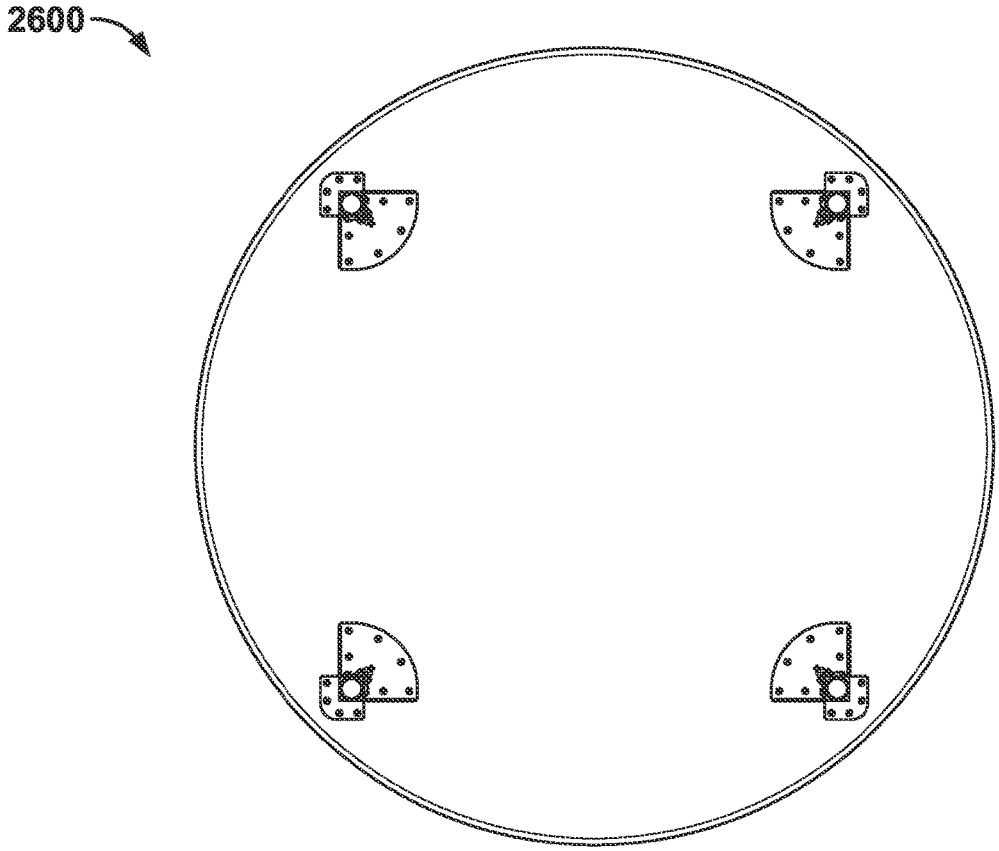
FIG. 26 shows another illustrative apparatus in accordance with principles of the disclosure.

FIG. 26 shows illustrative table 2600. FIG. 26 may show a bottom view of table 2600. FIG. 26 may show a bottom view of table 2500. Table 2600 may include 4 apparatuses. Table 2600 may include 4 table legs. Apparatuses may be similar to apparatus 100 described in detail above. Table legs may be similar to table leg 500 described in detail above.

Figure 27:
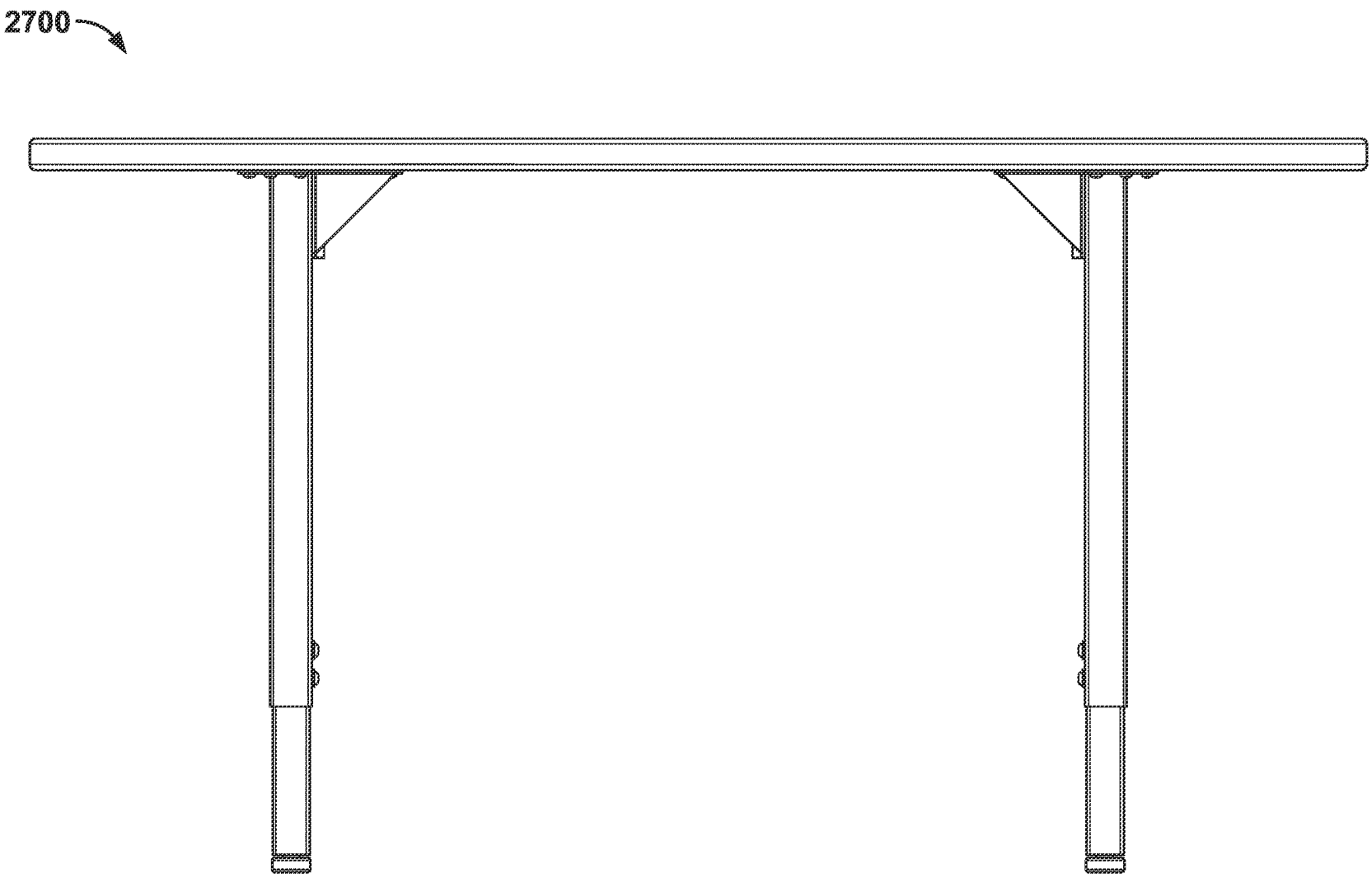
FIG. 27 shows another illustrative apparatus in accordance with principles of the disclosure.

FIG. 27 shows illustrative table 2700. FIG. 27 may show a side view of table 2700. FIG. 27 may show a side view of table 2500.

Figure 28:
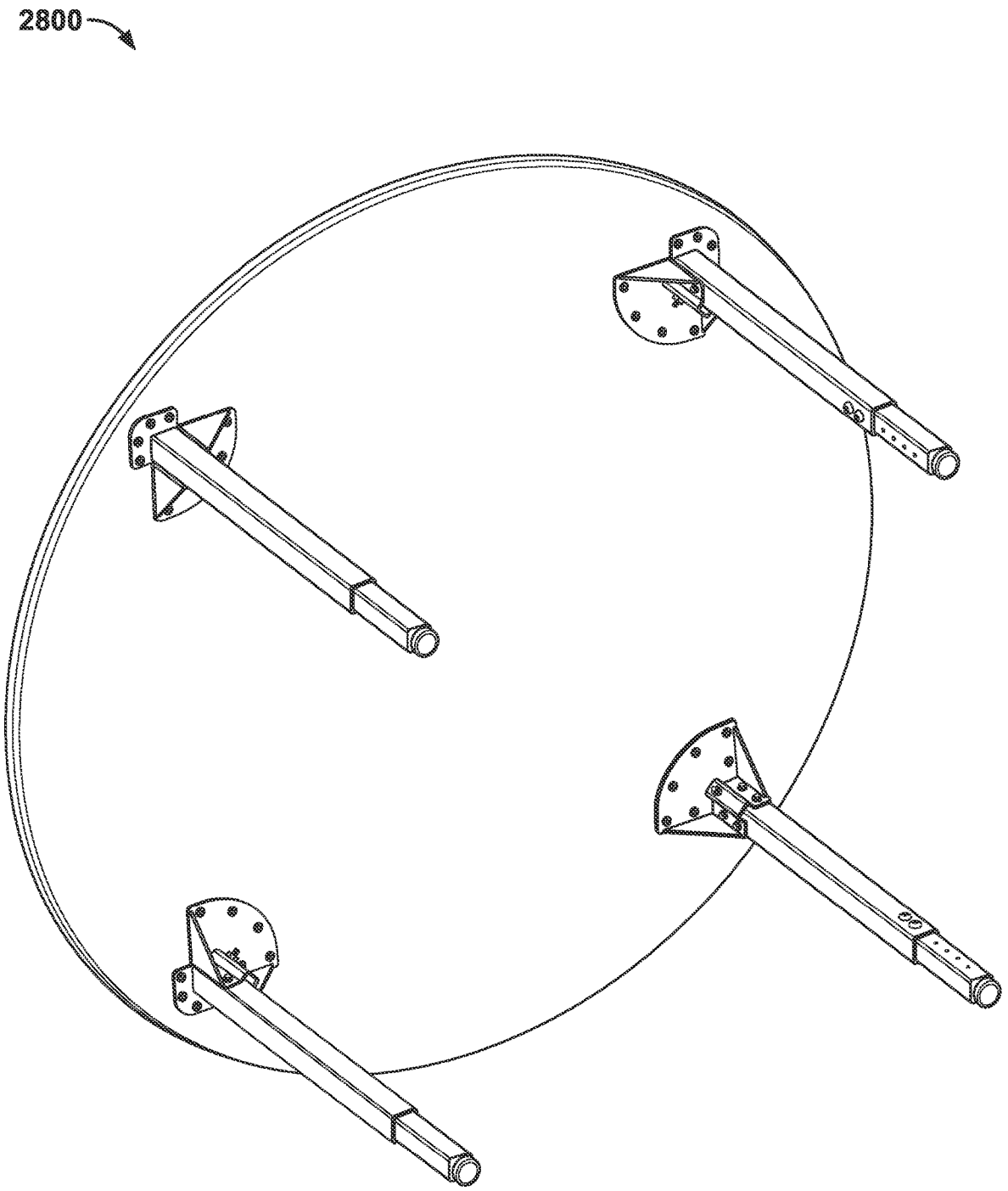
FIG. 28 shows another illustrative apparatus in accordance with principles of the disclosure.

FIG. 28 shows illustrative table 2800. FIG. 28 may show a bottom skewed view of table 2800. FIG. 28 may show a bottom skewed view of table 2500.

Figure 29:
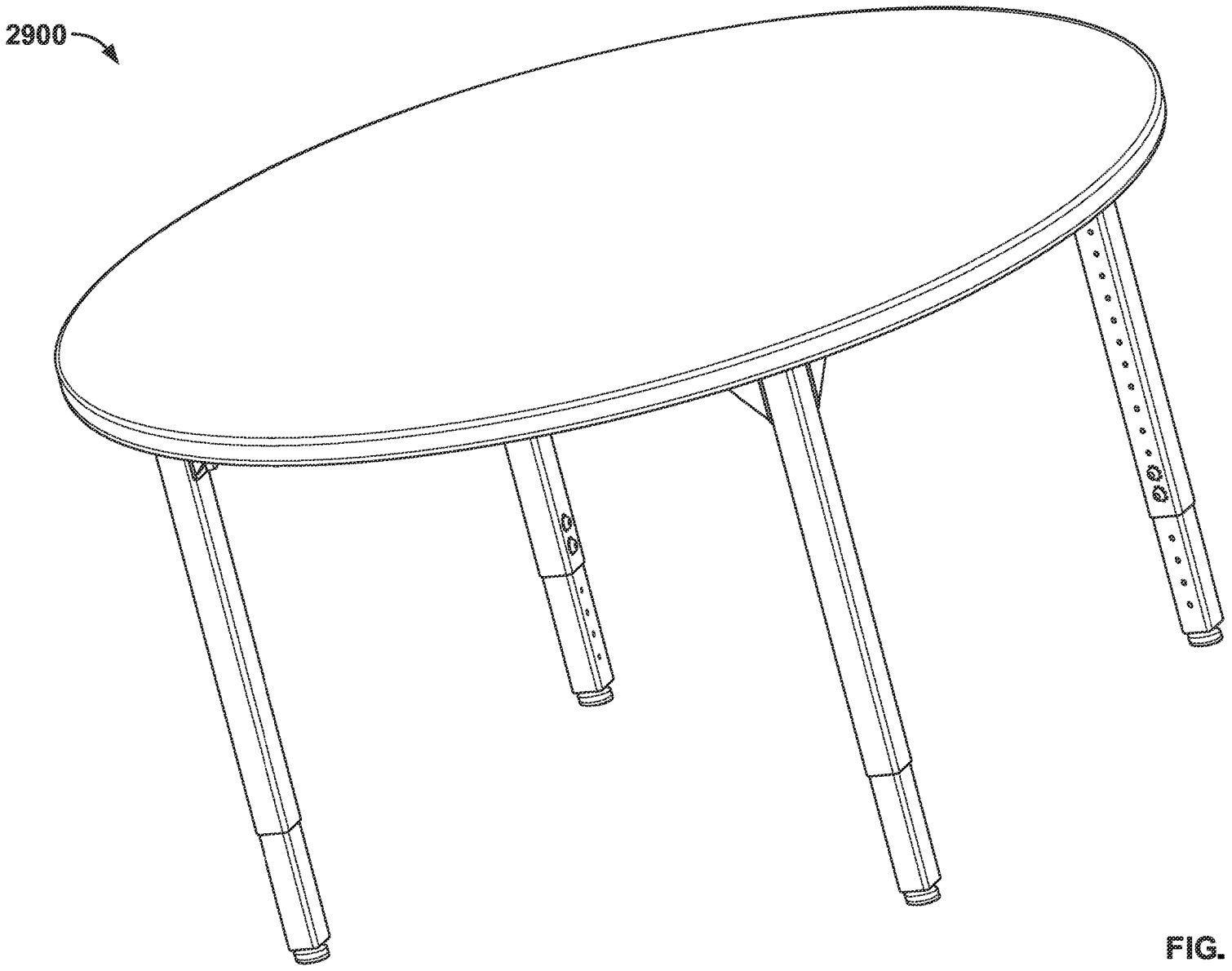
FIG. 29 shows another illustrative apparatus in accordance with principles of the disclosure.

FIG. 29 shows illustrative table 2900. FIG. 29 may show a top skewed view of table 2900. FIG. 29 may show a top skewed view of table 2500.

Figure 30:
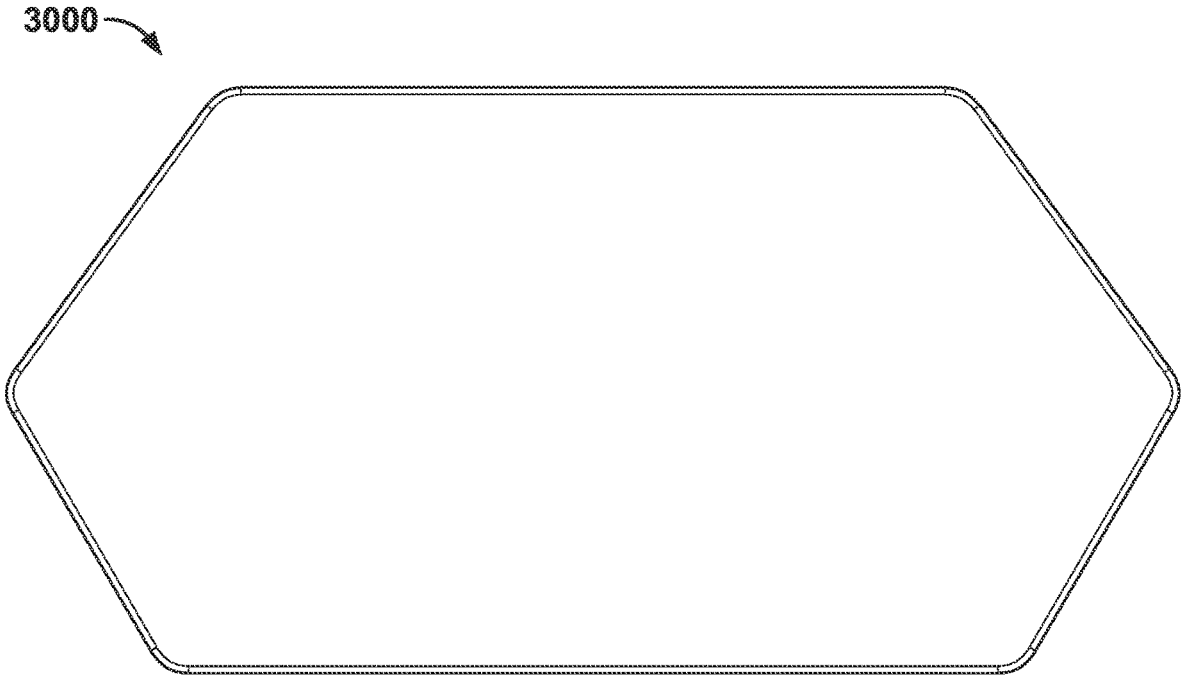
FIG. 30 shows another illustrative apparatus in accordance with principles of the disclosure.

FIG. 30 shows illustrative table 3000. FIG. 30 shows a top view of table 3000. Table 3000 may include a hexagonal shape. Table 3000 may include a particleboard core, a wood core, a plastic core, a metal core or any other suitable core. In a preferred embodiment table 3000 includes a particleboard core. Table 3000 may include a tabletop. Tabletop may include a top surface and a bottom surface. Top surface may include one of a high pressure laminate, a whiteboard, a chemical resistant top or any other suitable surface finish. Bottom surface may omit a surface finish. Bottom surface may include the same surface finish as the top surface. Bottom surface may include a different surface finish as the top surface. Tabletop may omit edge banding. Tabletop may include edge banding. Edge banding may include PVC edge banding, T-molding, chemical resistant edge banding or any other suitable edge banding.

Figure 31:
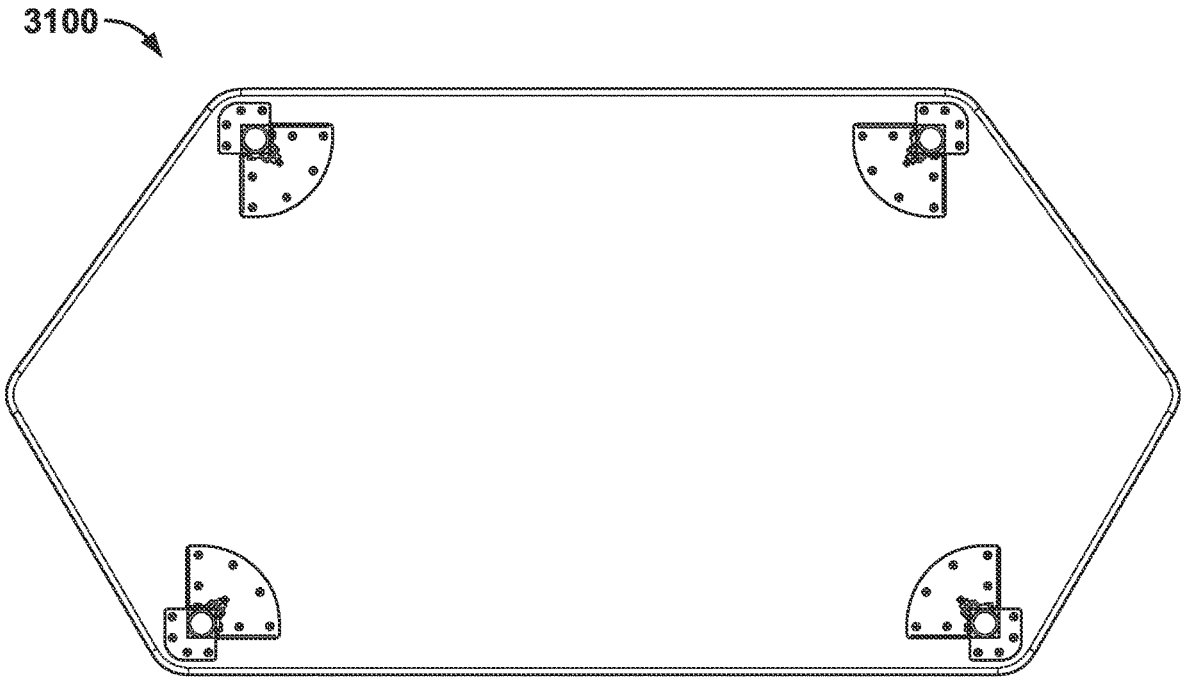
FIG. 31 shows another illustrative apparatus in accordance with principles of the disclosure.

FIG. 31 shows illustrative table 3100. FIG. 31 may show a bottom view of table 3100. FIG. 31 may show a bottom view of table 3000. Table 3100 may include 4 apparatuses. Table 3100 may include 4 table legs. Apparatuses may be similar to apparatus 100 described in detail above. Table legs may be similar to table leg 500 described in detail above.

Figure 32:
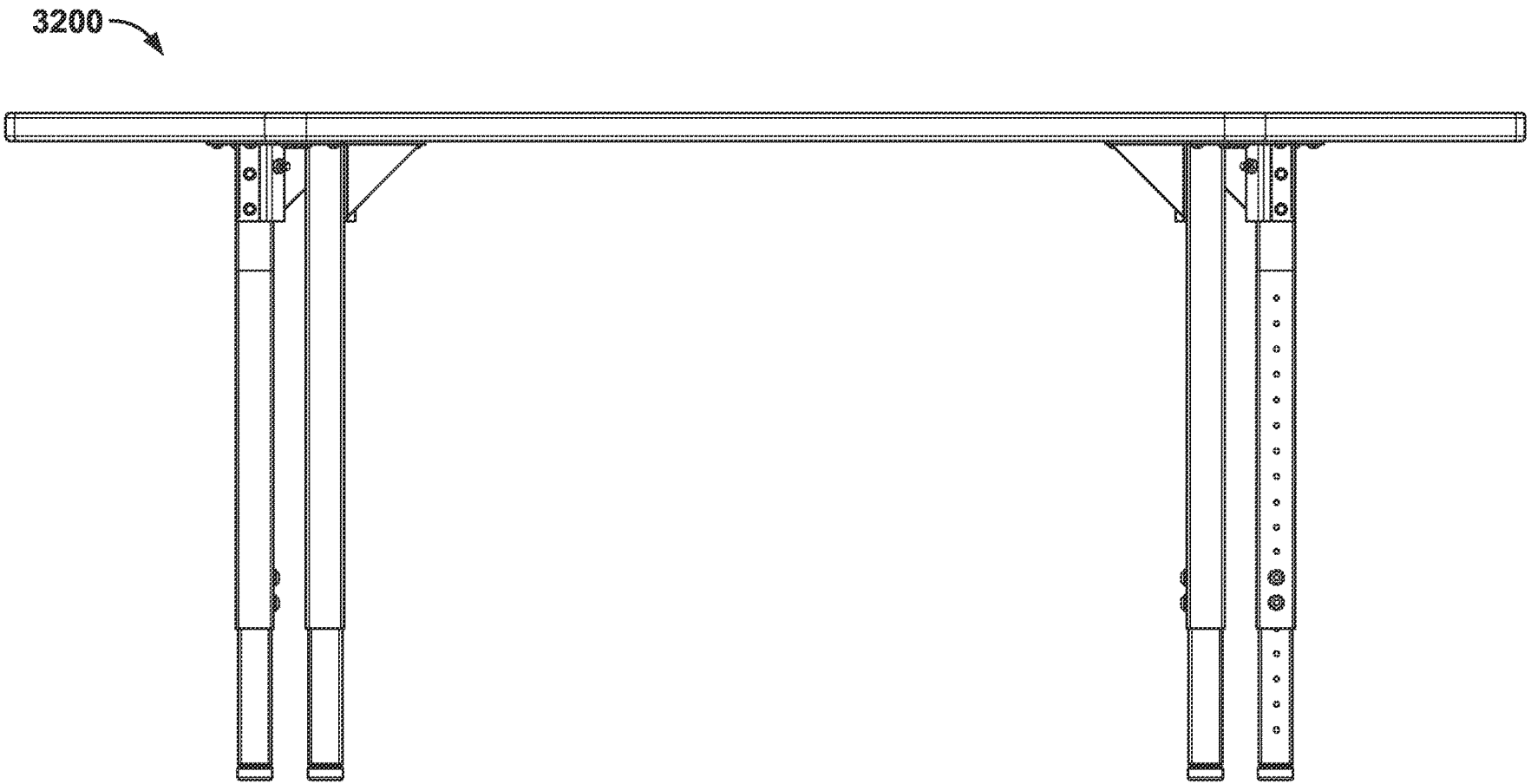
FIG. 32 shows another illustrative apparatus in accordance with principles of the disclosure.

FIG. 32 shows illustrative table 3200. FIG. 32 may show a side view of table 3200. FIG. 32 may show a side view of table 3000.

Figure 33:
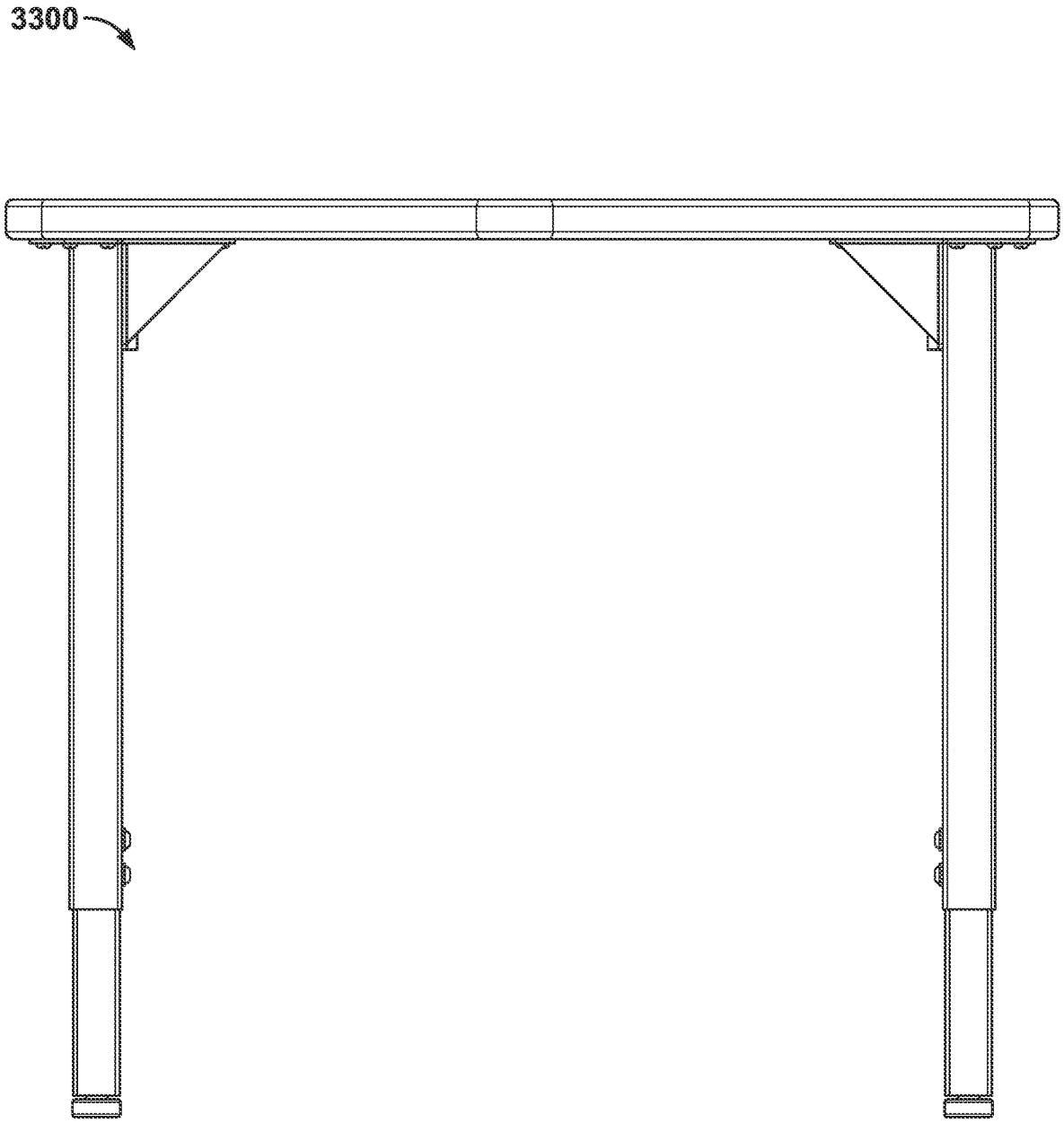
FIG. 33 shows another illustrative apparatus in accordance with principles of the disclosure.

FIG. 33 shows illustrative table 3300. FIG. 33 may show a side view of table 3300. FIG. 33 may show another side view of table 3000.

Figure 34:
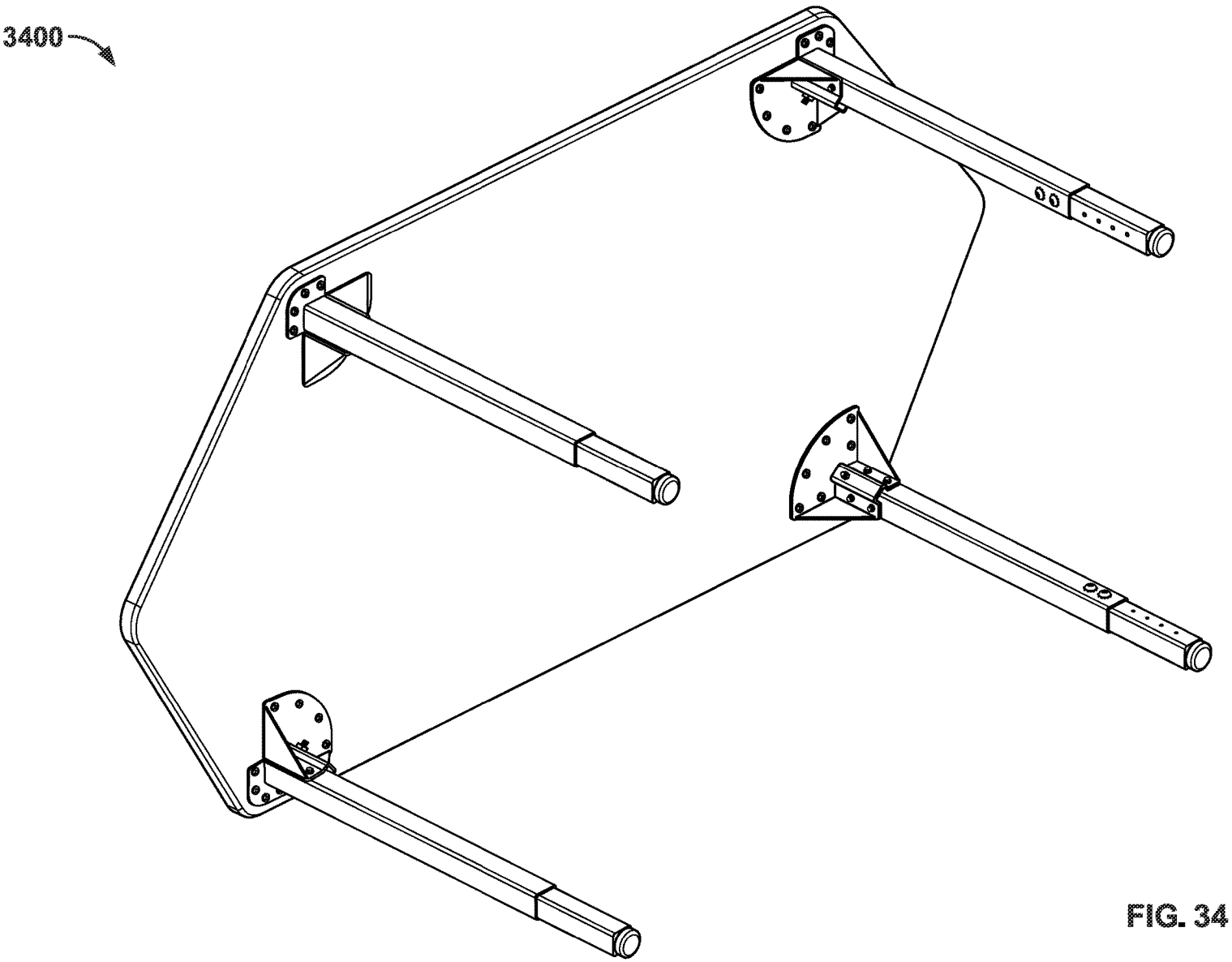
FIG. 34 shows another illustrative apparatus in accordance with principles of the disclosure.

FIG. 34 shows illustrative table 3400. FIG. 34 may show a bottom skewed view of table 3400. FIG. 34 may show a bottom skewed view of table 3000.

Figure 35:
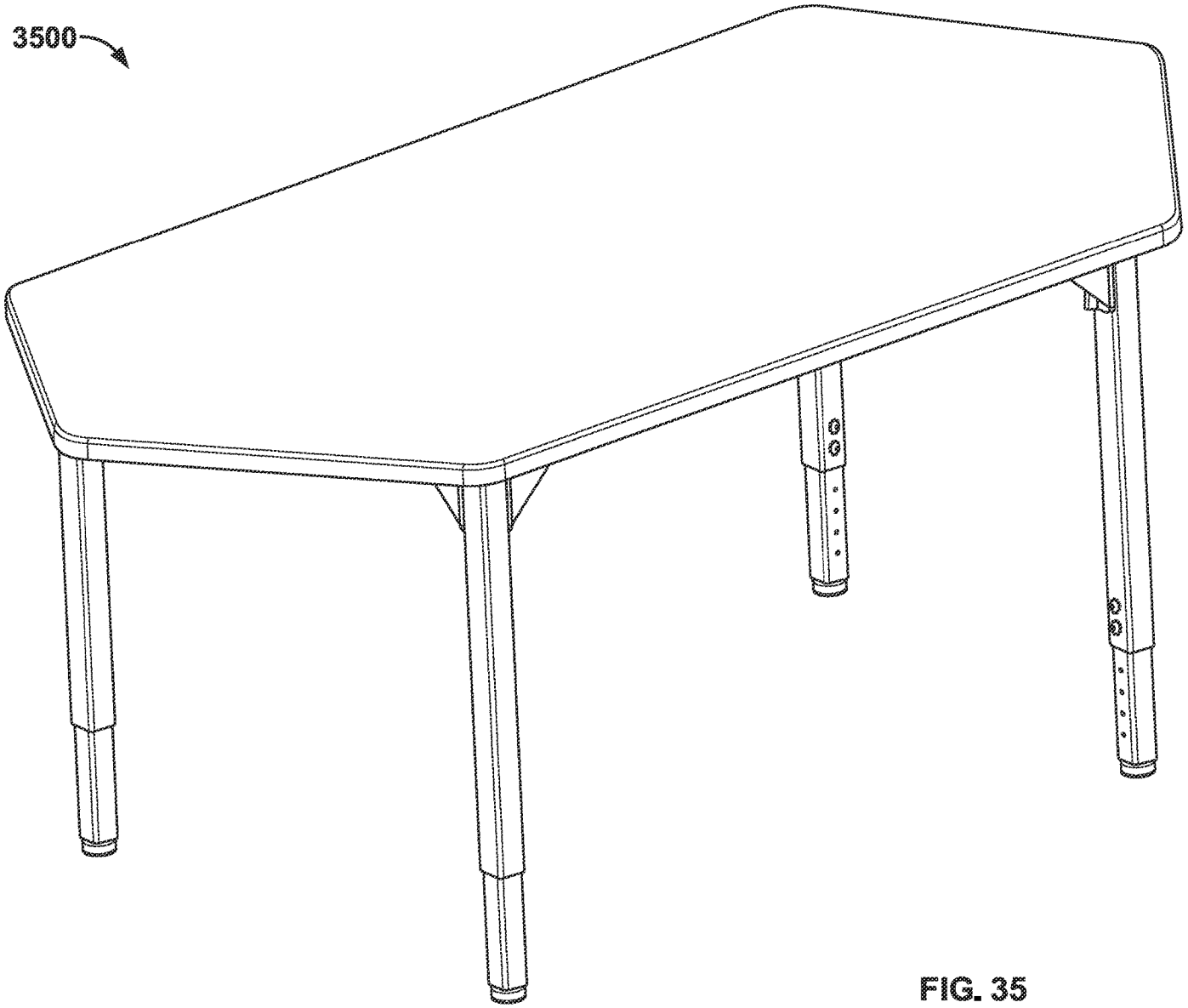
FIG. 35 shows another illustrative apparatus in accordance with principles of the disclosure.

FIG. 35 shows illustrative table 3500. FIG. 35 may show a top skewed view of table 3500. FIG. 35 may show a top skewed view of table 3000.

Figure 36:
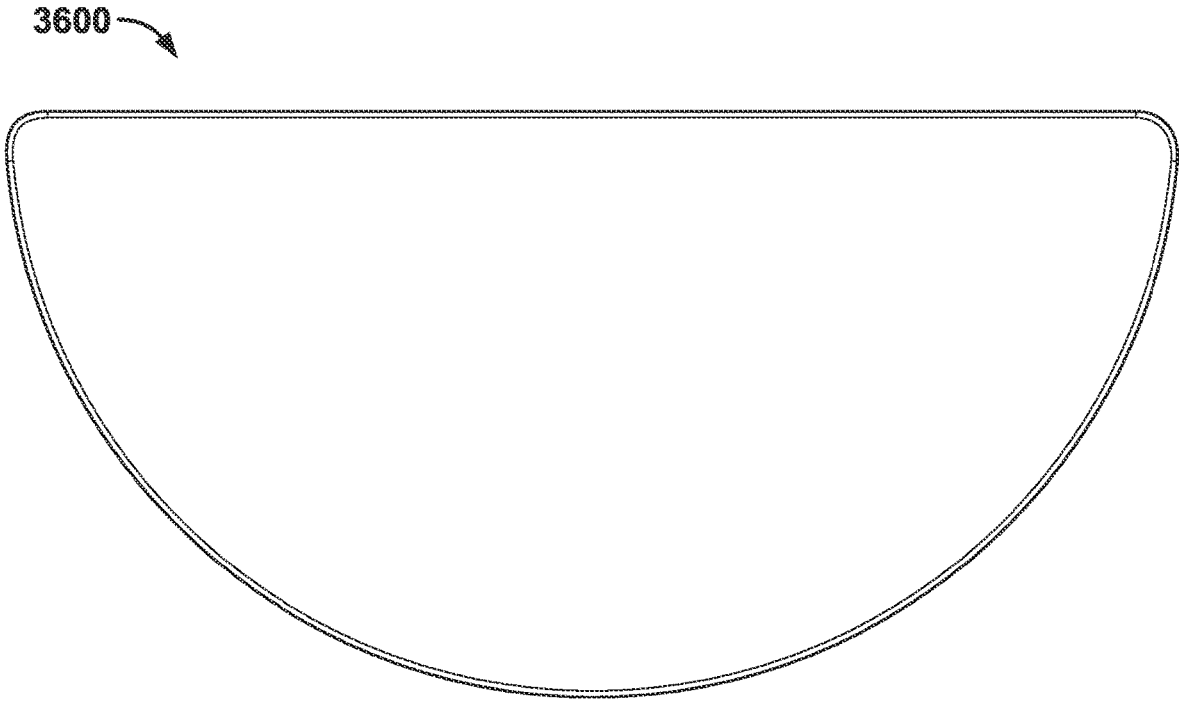
FIG. 36 shows another illustrative apparatus in accordance with principles of the disclosure.

FIG. 36 shows illustrative table 3600. FIG. 36 shows a top view of table 3600. Table 3600 may include a semi-circular shape. Table 3600 may include a particleboard core, a wood core, a plastic core, a metal core or any other suitable core. In a preferred embodiment table 3600 includes a particleboard core. Table 3600 may include a tabletop. Tabletop may include a top surface and a bottom surface. Top surface may include one of a high pressure laminate, a whiteboard, a chemical resistant top or any other suitable surface finish. Bottom surface may omit a surface finish. Bottom surface may include the same surface finish as the top surface.

Bottom surface may include a different surface finish as the top surface. Tabletop may omit edge banding. Tabletop may include edge banding. Edge banding may include PVC edge banding, T-molding, chemical resistant edge banding or any other suitable edge banding.

Figure 37:
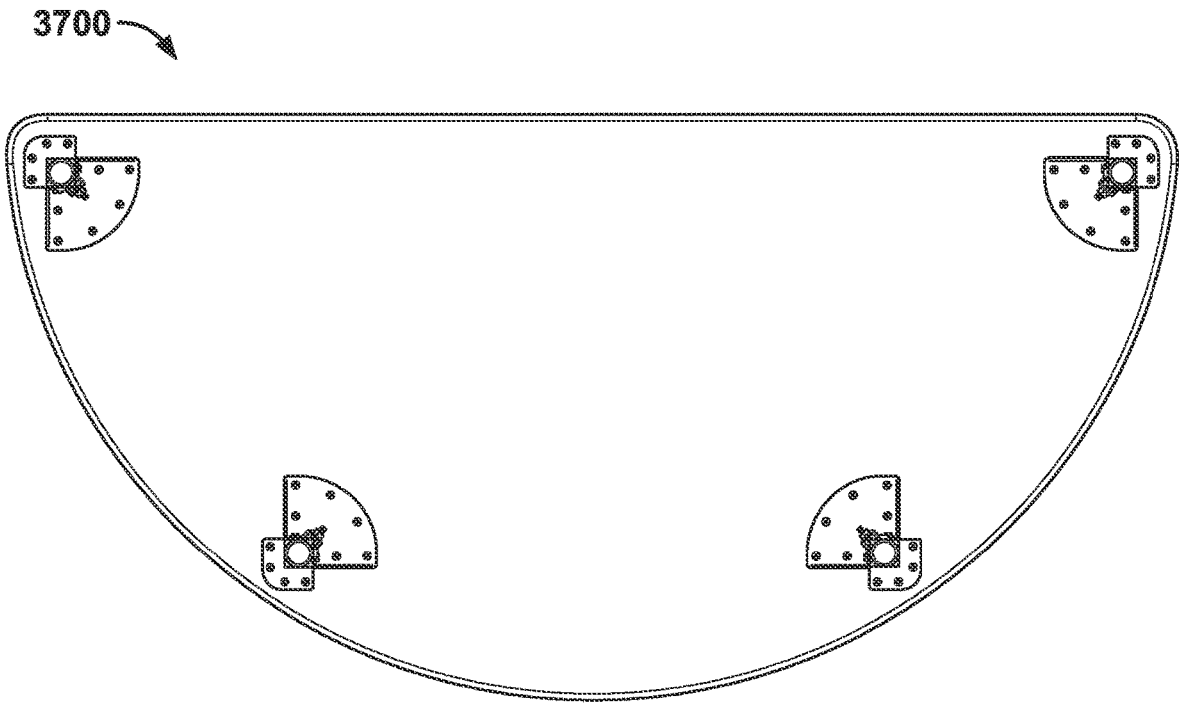
FIG. 37 shows another illustrative apparatus in accordance with principles of the disclosure.

FIG. 37 shows illustrative table 3700. FIG. 37 may show a bottom view of table 3700. FIG. 37 may show a bottom view of table 3600. Table 3700 may include 4 apparatuses. Table 3700 may include 4 table legs. Apparatuses may be similar to apparatus 100 described in detail above. Table legs may be similar to table leg 500 described in detail above.

Figure 38:
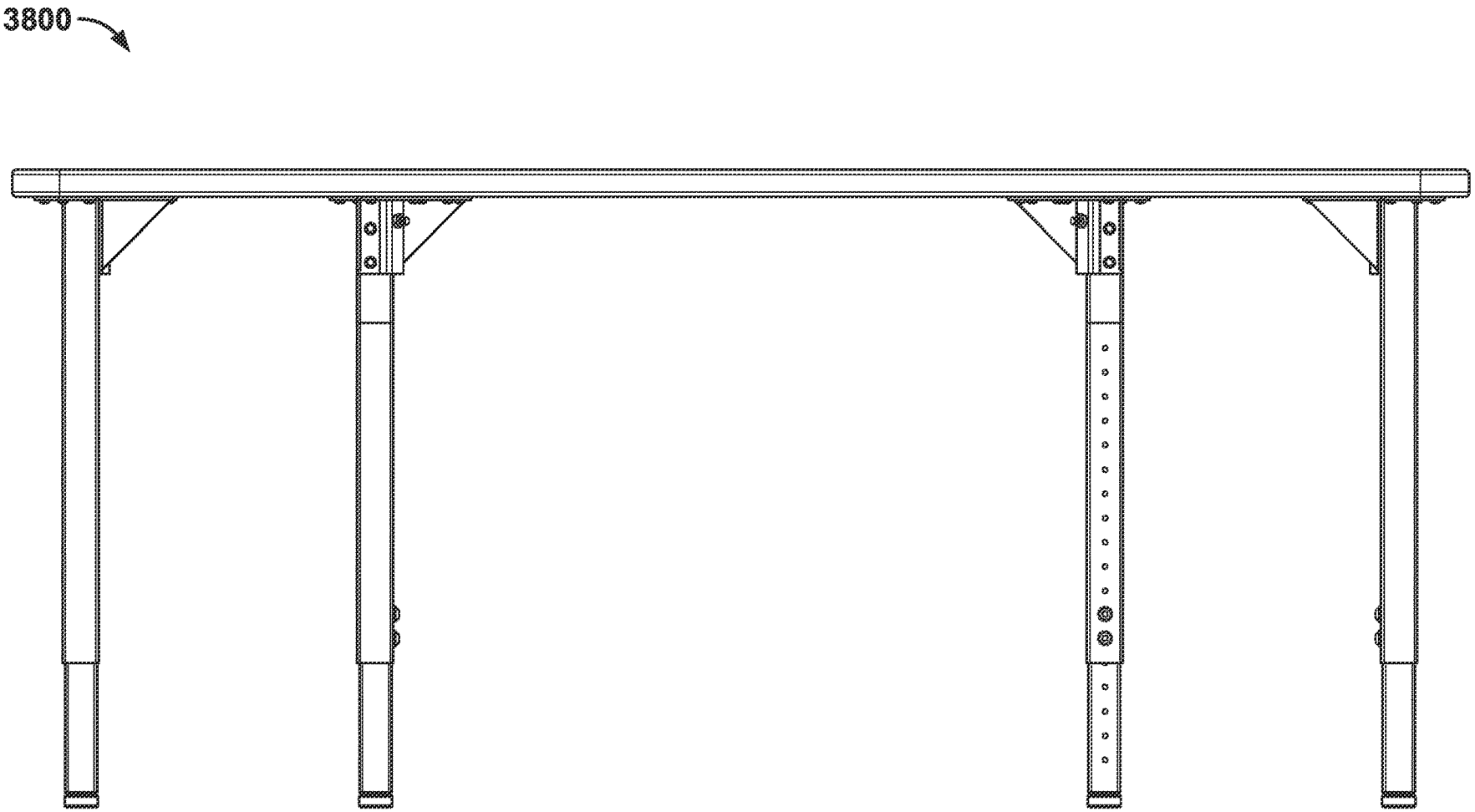
FIG. 38 shows another illustrative apparatus in accordance with principles of the disclosure.

FIG. 38 shows illustrative table 3800. FIG. 38 may show a side view of table 3800. FIG. 38 may show a side view of table 3600.

Figure 39:
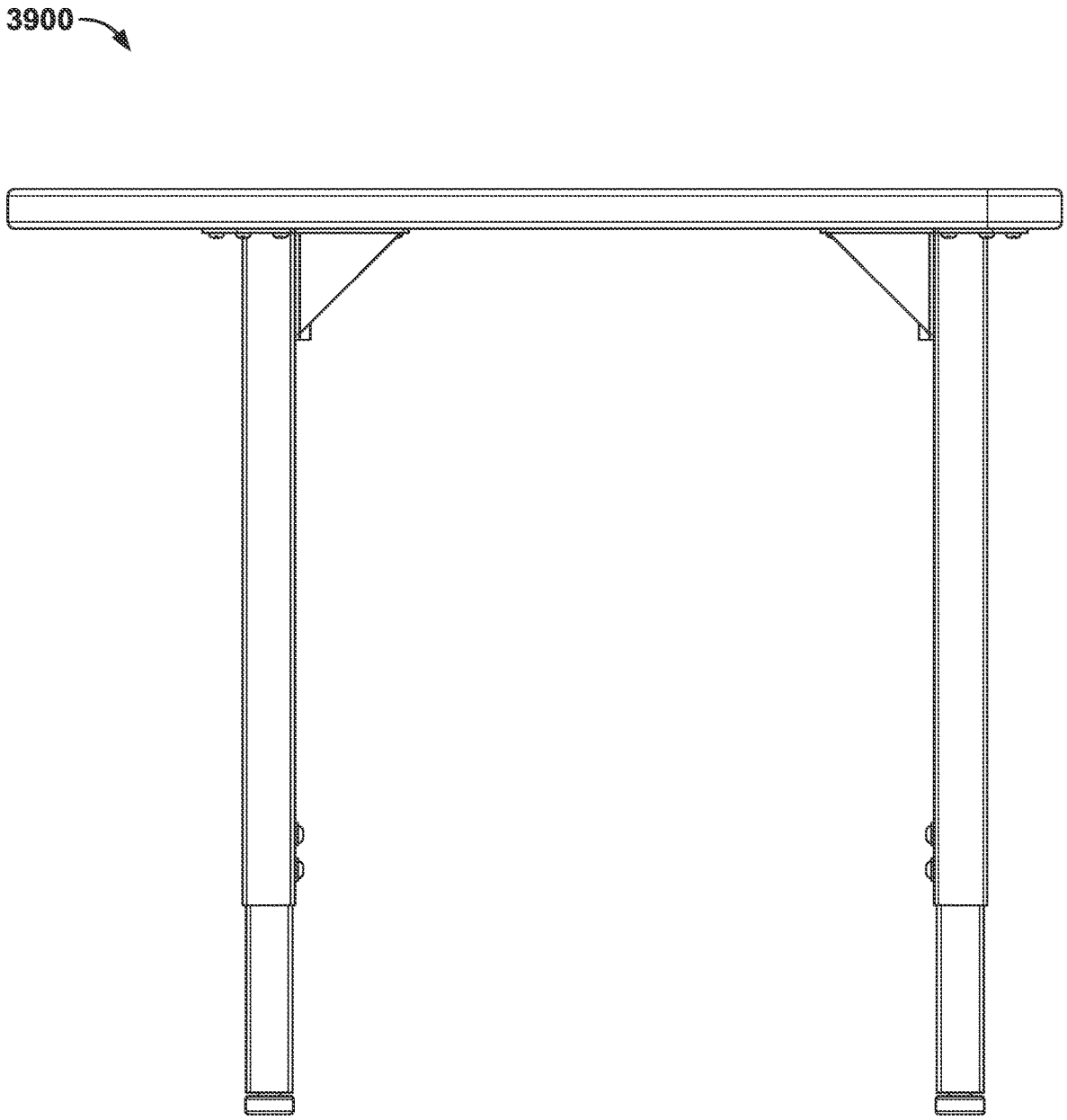
FIG. 39 shows another illustrative apparatus in accordance with principles of the disclosure.

FIG. 39 shows illustrative table 3900. FIG. 39 may show a side view of table 3900. FIG. 39 may show another side view of table 3600.

Figure 40:
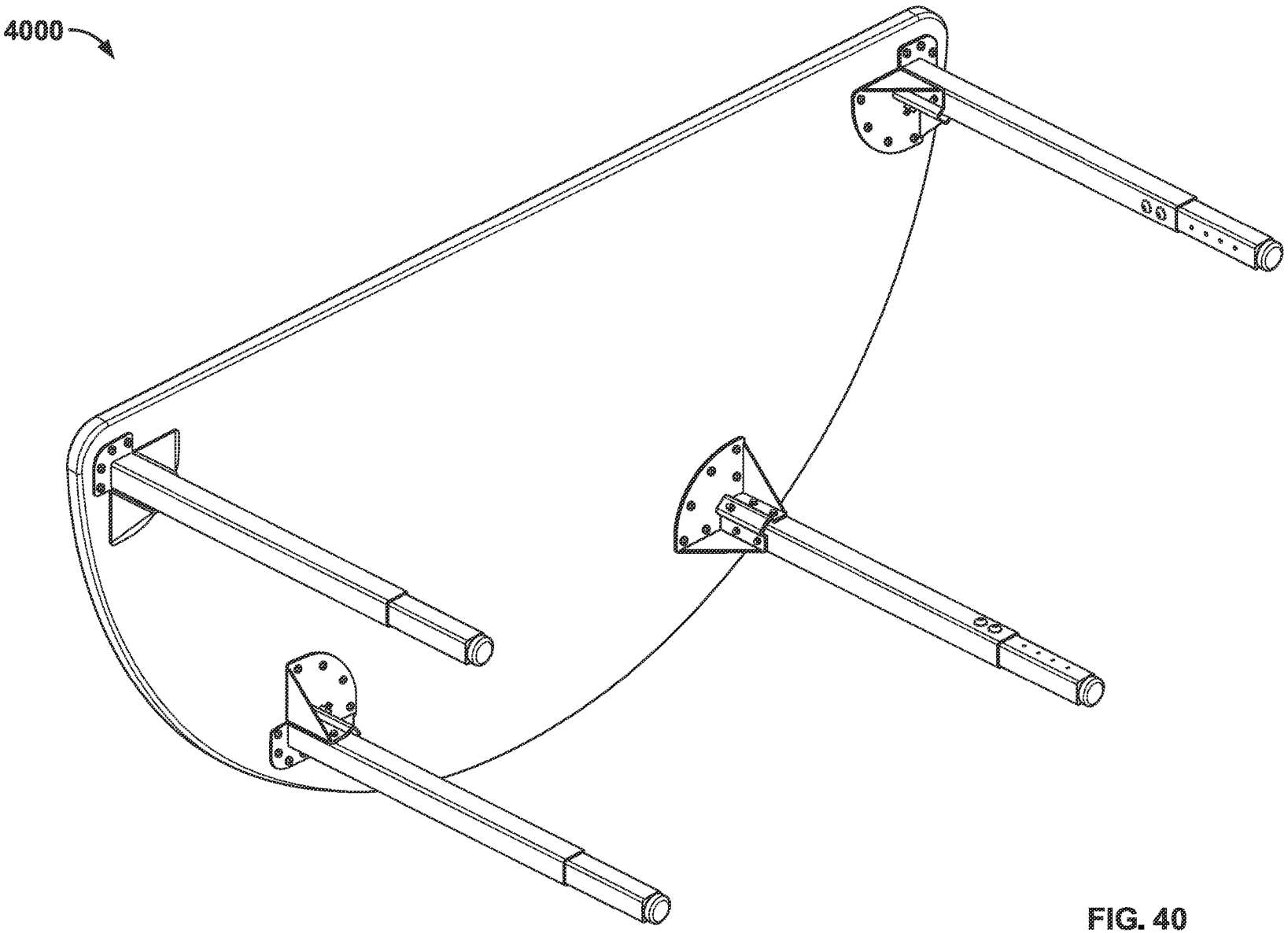
FIG. 40 shows another illustrative apparatus in accordance with principles of the disclosure.

FIG. 40 shows illustrative table 4000. FIG. 40 may show a bottom skewed view of table 4000. FIG. 40 may show a bottom skewed view of table 3600.

Figure 41:
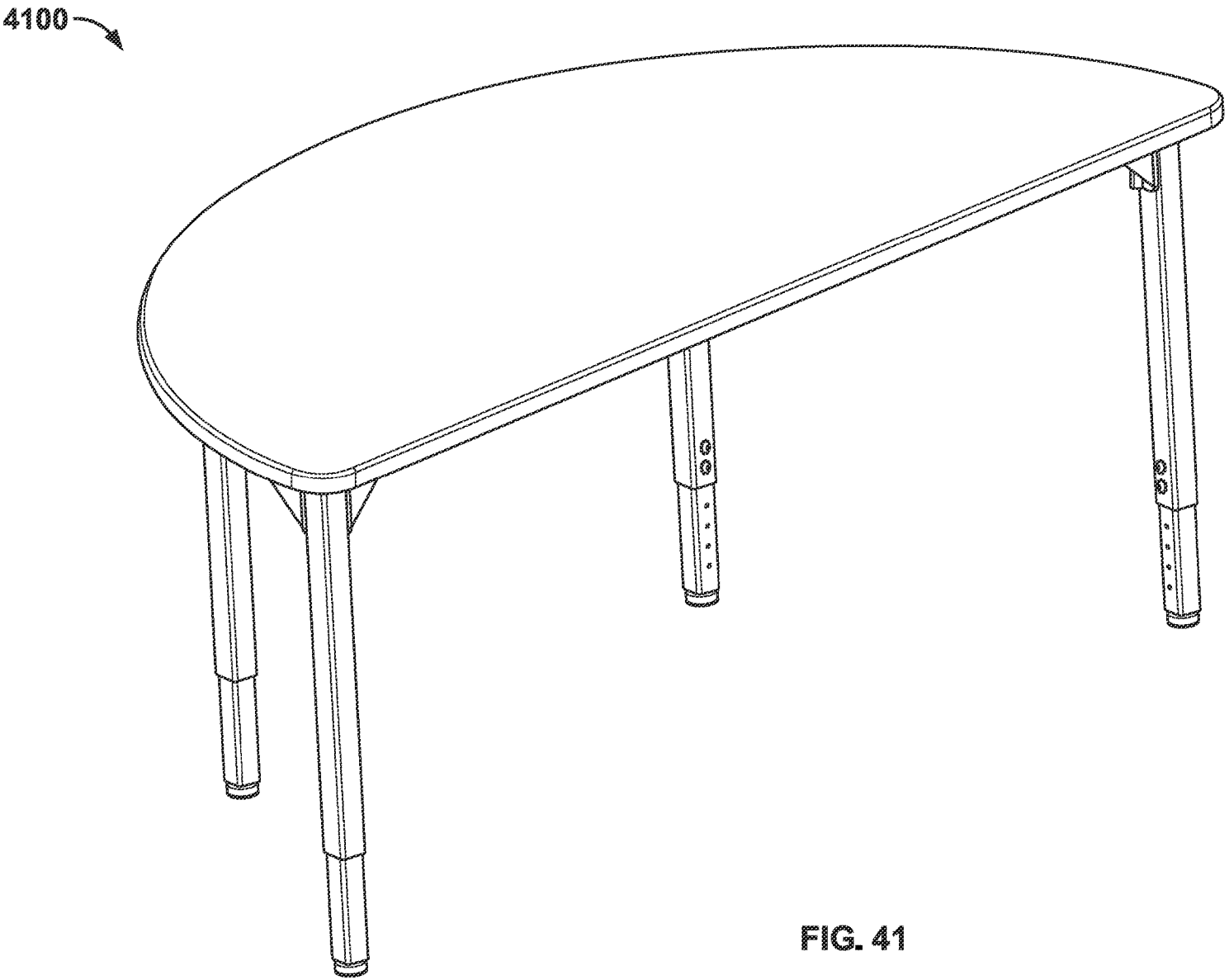
FIG. 41 shows another illustrative apparatus in accordance with principles of the disclosure.

FIG. 41 shows illustrative table 4100. FIG. 41 may show a top skewed view of table 4100. FIG. 41 may show a top skewed view of table 3600.

The apparatus and methods may include a method of assembling a table.

The table may be assembled by mounting a plurality of apparatuses to a tabletop and mounting a corresponding table leg to each apparatus. The apparatuses may each include an apparatus similar to apparatus 100 described in detail above. There may be 3, 4, 5, 6 or any suitable number of apparatuses mounted to the tabletop. The table leg may include a table leg similar to table leg 500 described in detail above. There may be a corresponding number of table legs to apparatuses. The tabletop may be similar to the tabletop shown in FIGS. 8, 14, 20, 25, 30 and 36 described in detail above.

The mounting an apparatus to a tabletop may include inserting screws through holes in the apparatus and into the tabletop. The holes may be similar to holes 107 in apparatus 100. The screws may be similar to screw 600 shown in FIG. 6. The screws may be any suitable screw. There may be 4, 5, 6, 7, 8 or any suitable numbers of holes of corresponding screws. More screws may provide for increased mounting strength. More holes in the apparatus may weaken the apparatus. According to the principles of the invention in a preferred embodiment 6 holes and corresponding screws may provide maximum mounting strength while maintaining the strength of the apparatus.

The mounting a table leg to the apparatus may include inserting a bolt through a hole in the apparatus. The bolt may be included in the table leg. The bolt may be similar to bolt 507 of table leg 500. The bolt may be threaded. The hole may be similar to hole 113 of apparatus 100. After insertion a nut may be screwed onto the end of the bolt. The nut may be tightened to secure the table leg to the apparatus.

Tightening the nut onto the bolt may mount the table leg to the apparatus. Inserting screws through holes in the apparatus and into the table leg may add additional strength to the mount. The screws may be similar to screw 700 shown in FIG. 7. The screws may be any suitable screw. The screws may be self-tapping. Self-tapping screws may be able to drive into the metal table leg. Self-tapping screws may be able to drive into the metal table leg without predrilled holes. More screws may provide for increased mounting strength. More holes in the apparatus may weaken the apparatus. More holes created in the top portion of the table leg may weaken the top portion of the table leg. According to the principles of the invention in a preferred embodiment 2 holes and corresponding screws may provide maximum mounting strength while maintaining the strength of the apparatus and table leg.

The assembled table may be similar to the tables shown in FIGS. 8-41 and described in detail above. The assembled table may support at least 500 pounds of weight distributed across the tabletop. The assembled table may support at least 500 pounds of weight without including an apron or stabilizing bars. The lack of an apron, stabilizing bars or foldable legs may maximize the usable seating area underneath the table. The design of apparatus 100 as described in detail above may provide increased strength in mounting the table leg to the tabletop. Apparatus 100 as described in detail above may prevent table legs from being pulled out of the table due to excessive weight.

The assembled table may be easily assembled. Apparatus 100 may be used to mount conventional table legs to conventional tabletops. Apparatus 100 may be used to retrofit conventional tabletops and table legs into a heavy duty activity table. The assembled table may be easily disassembled. The disassembled table may be easily stored.

Methods for designing, rendering, and producing the disclosed apparatus are also disclosed. Designing and/or rendering the disclosed apparatus may include creating a digital image based on specification inputs. The specification inputs may include components and/or dimensions disclosed herein.

The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

Thus, methods and systems for an apparatus for mounted a table leg to a tabletop and assembling a table are provided. Persons skilled in the art will appreciate that the present invention can be practiced by other than the described embodiments, which are presented for purposes of illustration rather than of limitation, and that the present invention is limited only by the claims that follow.

What is claimed is:

1. Apparatus for mounting a table leg to a tabletop, the apparatus comprising:

a base configured to be mounted to the tabletop via first holes defined in the base;

a bracket configured to be mounted to the table leg, the bracket comprising:

a U-shaped channel, the U-shaped channel defining a second hole configured to accept a bolt included in the table leg;

a first wing extending from a first end of the U-shaped channel, the first wing defining third holes configured to mount the bracket to the table leg such that a first side of the table leg lies flat against an inner surface of the first wing; and a second wing extending from a second end of the U-shaped channel, the second wing defining fourth holes configured to mount the bracket to the table leg such that a second side of the table leg lies flat against an inner surface of the second wing;

a first support configured to connect the base to the bracket, the first support is connected to an outer surface of the first wing; and a second support configured to connect the base to the bracket, the second support is connected to an outer surface of the second wing.

2. The apparatus of claim 1, wherein:

the base defines a cutout configured to receive the table leg;

the inner surface of the first wing is flush with a first edge of the cutout; and the inner surface of the second wing is flush with a second edge of the cutout.

3. The apparatus of claim 2 wherein:

each of the first and second supports are triangular;

the connection between the first support and the base forms a first side of a first triangle;

the connection between the first support and the bracket forms a second side of the first triangle;

the connection between the second support and the base forms a first side of a second triangle; and the connection between the second support and the bracket forms a second side of the second triangle.

4. The apparatus of claim 2, wherein the first and second supports are connected to the base and bracket via welding.

5. The apparatus of claim 4, wherein there is no weld on the inner surface of the first and second wings.

6. The apparatus of claim 2, wherein the first support is welded such that it is flush with a first edge of the base and an edge of the first wing and the second support is welded such that it is flush with a second edge of the base and an edge of the second wing.

7. The apparatus of claim 1, wherein the apparatus is made from 11 gauge steel.

8. The apparatus of claim 7, wherein the apparatus is powder coated.

9. The apparatus of claim 1, wherein there are a corresponding number of third holes as fourth holes and the third holes that correspond to the fourth holes are defined in a same vertical and horizontal plane of the bracket.

10. The apparatus of claim 1, wherein the first holes comprise at least six first holes.

11. A method for assembling a table, the method comprising:

mounting a plurality of apparatuses to a tabletop; and mounting a table leg to each apparatus;

wherein:

each apparatus comprises:

a base configured to be mounted to the tabletop via first holes defined in the base;

a bracket configured to be mounted to the corresponding table leg, the bracket comprising:

a U-shaped channel, the U-shaped channel defining a second hole configured to accept a bolt included in the corresponding table leg;

a first wing extending from a first end of the U-shaped channel, the first wing defining third holes configured to mount the bracket to the corresponding table leg such that a first side of the corresponding table leg lies flat against an inner surface of the first wing; and a second wing extending from a second end of the U-shaped channel, the second wing defining fourth holes configured to mount the bracket to the corresponding table leg such that a second side of the corresponding table leg lies flat against an inner surface of the second wing;

a first support configured to connect the base to the bracket, the first support is connected to an outer surface of the first wing; and a second support configured to connect the base to the bracket, the second support is connected to an outer surface of the second wing;

the mounting of each apparatus to the tabletop comprises inserting first screws through the first holes into the tabletop; and the mounting the corresponding table leg onto each corresponding apparatus comprises:

inserting the corresponding bolt through the corresponding second hole;

after the insertion of the corresponding bolt tightening a corresponding nut on the corresponding bolt to align the corresponding table leg with the corresponding apparatus; and inserting corresponding second screws through the corresponding third and fourth holes into the corresponding table leg.

12. The method of claim 11 wherein the second screws are self-tapping screws.

13. The method of claim 11 wherein when the table is assembled the plurality of apparatuses and corresponding table legs are configured to support at least 500 pounds of weight distributed across the tabletop.

14. The method of claim 11 wherein the plurality of apparatuses includes four apparatuses.

15. The method of claim 11 wherein each table leg is height adjustable.

16. The method of claim 11 wherein the tabletop includes a particleboard core.

17. The method of claim 16 wherein a tabletop surface is one of a high pressure laminate, a whiteboard or a chemical resistant top.

18. The method of claim 16 wherein the particleboard core includes one of PVC edge banding, T-molding or chemical resistant edge banding.

19. The method of claim 13 wherein the assembled table does not include an apron or stabilizing bars.

20. The method of claim 11 wherein the shape of the tabletop is one of a trapezoid, rectangle, circle, semicircle, hexagon or a semi-angular shape.

* * * * *